US006431676B2

(12) United States Patent
Asauchi et al.

(10) Patent No.: US 6,431,676 B2
(45) Date of Patent: Aug. 13, 2002

(54) GENERATION OF DRIVING WAVEFORMS TO ACTUATE DRIVING ELEMENTS OF PRINT HEAD

(75) Inventors: Noboru Asauchi; Koichi Otsuki, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/765,607

(22) Filed: Jan. 22, 2001

(30) Foreign Application Priority Data

Jan. 28, 2000 (JP) ..... 2000-19932
Mar. 14, 2000 (JP) ..... 2000-070418

(51) Int. Cl.[7] ..... B41J 29/38
(52) U.S. Cl. ..... 347/10; 347/9; 347/11
(58) Field of Search ..... 347/9, 10, 11, 347/68

(56) References Cited

U.S. PATENT DOCUMENTS 4,368,491 A * 1/1983 Saito ..... 358/460
5,142,302 A 8/1992 Kano ..... 347/172
6,312,076 B1 * 11/2001 Taki et al. ..... 347/10

FOREIGN PATENT DOCUMENTS

EP 0 916 505 5/1999 ..... H04N/1/04
JP 10-202868 8/1998 ..... B41J/2/045
JP 10-329313 12/1998 ..... B41J/2/01
JP 2940542 6/1999 ..... B41J/2/205

* cited by examiner

*Primary Examiner*—John Barlow
*Assistant Examiner*—Alfred Dudding
(74) *Attorney, Agent, or Firm*—Oblon, Spivak, McClelland, Maier & Neustadt, P.C.

(57) ABSTRACT

The present invention generates voltage signals or driving waveforms to actuate driving elements of a print head according to the programmable generation method discussed below. The procedure first provides a first memory area and a second memory area, in which driving waveform data used to generate the driving waveforms are stored. Different sets of the driving waveform data are stored in the respective memory areas. The procedure selects a working memory area at a predetermined interval of selection and carries out arithmetic operations using the set of driving waveform data stored in the selected working memory area, so as to generate a driving waveform signal. The selective use of the working memory area enables the resulting driving waveform to be switched over at a high speed at the predetermined interval of selection. The two memory areas may be constructed by separate memory chips. This configuration enables a reading operation from one memory area to be carried out in parallel with a writing operation into the other memory area. The arrangement of the present invention attains the high-speed changeover of a working driving waveform among a diversity of driving waveforms, while preventing a significant increase in memory capacity.

20 Claims, 20 Drawing Sheets

PRIOR ART

PRIOR ART

GENERATION OF DRIVING WAVEFORMS TO ACTUATE DRIVING ELEMENTS OF PRINT HEAD

BACKGROUND OF THE INVENTION

1. Field of the Invention

The present invention relates to a technique that generates driving waveforms to actuate driving elements of a print head.

2. Description of the Related Art

A color ink jet printer that ejects several color inks from a print head is one of the output devices of the computer. The ink jet printer expresses multiple tones by distribution of dots. In order to attain the smoother tone expression, some ink jet printers create variable size dots in respective pixels. Some ink jet printers carry out printing in both forward and backward passes of main scan, thereby enhancing printing speed.

The ink jet printer regulates the weight of ink droplets ejected from nozzles of the print head to create the respective dots. For example, the print head with piezoelectric elements regulates the size of each dot by controlling the meniscus or the shape of the ink surface at the nozzle opening and adjusting the ejection timing of the ink droplet. The driving waveform to drive the piezoelectric elements is varied to attain such control and adjustment.

FIG. 18 illustrates a prior art driving waveform to create the variable size dots. The driving waveform includes two element waveforms W1 and W2 that are output intervalically. The driving waveform has a interval T corresponding to one pixel division. The first element waveform W1 is used to create small size dots, and the second element waveform W2 is used to create medium size dots.

Large size dots are formed in response to both the first element waveform W1 and the second element waveform W2.

Various driving waveforms can be generated by a programmable signal generation circuit. The programmable signal generation circuit intervalically accumulates a preset value of voltage change in the driving waveform, that is, quantities of voltage change per unit time, with an adder, so as to determine the level of the driving waveform.

FIG. 19 is a block diagram illustrating the internal structure of a programmable signal generation circuit 100. FIG. 20 shows a process of generating a driving waveform by the prior art programmable generation. The driving waveform generation circuit 100 includes a memory 102, an accumulator 104, and a digital-to-analog (D-A) converter 106. Driving waveform data $\Delta V1$, $\Delta V2$, and $\Delta V3$, each representing a rate of voltage change in the driving waveform, are stored in the memory 102. Each of the driving waveform data corresponds to a quantity of voltage change in the driving waveform per interval t of a clock signal CLK. The driving waveform data $\Delta V1$, $\Delta V2$, and $\Delta V3$ read from the memory 102 are successively accumulated in synchronism with the clock signal CLK by the accumulator 104. The arithmetic operation gives 18-bit data as the result of accumulation. The upper 10 bits out of the 18-bit result of accumulation are subjected to the D-A conversion carried out by the D-A converter 106, so as to generate a driving waveform.

The number of reproducible tone levels increases as the number of available dot sizes and, in turn, as the number of element waveforms. There is, however, generally a restriction on the number of element waveforms included in one interval T. The prior art print head accordingly enables only a restricted number of different types of usable dots to be created.

SUMMARY OF THE INVENTION

The object of the present invention is to increase the number of different types of dots usable for printing.

At least part of the above and the other related objects is attained by a technique that selectively generates one of a plurality of different driving waveforms having different shapes at predetermined intervals of selection to actuate driving elements of a print head. The selective use of the plurality of different driving waveforms enables a variety of dots to be created without restriction on the number of element waveforms included in one interval.

In the technique of generating the driving waveforms in a programmable manner, changing the set of driving waveform data varies the resulting driving waveform. The switchover of the driving waveform is accordingly attained by appropriately rewriting the set of driving waveform data stored in the memory according to the desired driving waveform to be generated. This method, however, lengthens the time interval required for switching over the driving waveform. This is because no driving waveform is generated until the writing operation of a next set of driving waveform data is completed. The longer time interval required for the switchover may lower the printing speed and deteriorate the usability of the printing apparatus.

The technique of the present invention provides a specific number of memory areas, which are at least two memory areas and do not overlap one another at least partly, and changes over a working memory area used to generate the driving waveform, thereby switching over the resulting driving waveform. A set of driving waveform data used to generate each of the plurality of different driving waveforms is stored in each of the specific number of memory areas. This arrangement does not require the switchover operation of the working driving waveform to wait for the completion of the writing operation of the driving waveform data, thus attaining the high-speed switchover of the working driving waveform.

In the present invention, the predetermined interval of selection may corresponds to one pixel division. This arrangement effectively increases the number of different types of dots created in one pixel division during one pass of the main scan.

Here the term 'one pixel division' represents a time interval required for creating a dot at one pixel. The expression 'one pixel division' accordingly corresponds to the interval T of outputting the element waveforms W1 and W2 of the driving waveform shown in FIG. 18. The same principle is adopted in the case where the driving waveform includes three or more factor waveform element waveforms.

The term 'one pixel division' also has the following meaning. Printing is generally implemented by creating dots at respective pixel positions specified by a recording resolution. According to the relationship between the velocity of main scan and the driving speed of the print head, dots may be created on a raster line at a pitch of two or more pixels during one pass of the main scan. In one example, it is assumed that dots are created on a printing medium in a pattern shown in FIG. 1B in response to a driving waveform COM, which is output repeatedly at a interval T shown in FIG. 1A. The driving waveform COM output at the interval T enables dots to be created at every other pixel as shown in FIG. 1B. It is required to create dots in the residual alternate pixels by another pass of the main scan. In this case, the interval T still represents the time interval required for creating a dot at one pixel. The interval T accordingly corresponds to 'one pixel division'.

The predetermined intervals of selection can be set at a variety of length, for example, intervals of different change rate of the driving waveform or intervals corresponding to one pass of the main scan of the print head.

The switchover of the driving waveform according to the present invention is implemented by a variety of embodiments discussed below.

A first embodiment provides a specific number of memory areas that corresponds to the number of different driving waveforms, and stores a set of driving waveform data corresponding to each of the plurality of different driving waveforms into each of the memory areas. In this arrangement, the sets of driving waveform data corresponding to the available driving waveforms are stored separately in the individual memory areas. This arrangement does not require the writing operation of the driving waveform data prior to the switch over of the working driving waveform, thereby having high speed of generating the working driving waveform.

In a second embodiment, a reading/writing operation of each memory area is done independently of operations of the other memory areas. The writing operation of one set of driving waveform data into one memory area is carried out in parallel with the reading operation of another set of driving waveform data from another memory area. This parallel operation is free from the time loss due to the writing operation of the driving waveform data.

In accordance with a concrete procedure of the second embodiment, while a first driving waveform is generated by utilizing a set of driving waveform data stored in a first memory area, another set of driving waveform data required for generating a subsequent second driving waveform is written into a second memory area. When the generation of the first driving waveform is completed, the working memory area is changed over from the first memory area to the second memory area. This arrangement enables the second driving waveform to be generated without any delay.

The expression 'carrying out the writing operation in parallel with the reading operation' is not restricted to the case of carrying out the writing operation simultaneously with the reading operation, but includes the case of changing over the reading operation and the writing operation to be carried out in a specified time interval.

In the second embodiment, two memory areas at the minimum are sufficient for the switchover of three or more different driving waveforms. This advantageously saves the memory capacity.

It is preferable that the respective memory areas are constructed by separate memory chips. This configuration readily attains the independent reading and writing operations for each memory area. When each memory chip has a terminal of a select signal that controls the reading and writing operations, it is desirable to input an inversion signal of the select signal, which is input into one memory chip, into the other memory chip. This arrangement effectively uses the single select signal to simultaneously control the reading operation from one memory and the writing operation into the other memory.

In the second embodiment, when a new set of driving waveform data to be written into the writing memory coincides with the existing set of driving waveform data already stored in the same writing memory, the writing operation may be omitted.

In accordance with one preferable application, the generation of the driving waveform according to the technique of the present invention may follow the steps of: selecting a driving waveform to be generated at the predetermined interval of selection; sequentially reading a set of driving waveform data, which corresponds to the selected driving waveform, out of the corresponding memory area at a preset timing; successively accumulating the read-out driving waveform data at a preset accumulation timing; and carrying out digital-to-analog conversion of the accumulation result, so as to generate a driving waveform signal.

The plurality of different driving waveforms having different shapes may include a reference driving waveform and a corrected driving waveform, which is obtained by correcting the reference driving waveform with a predetermined parameter that affect printing properties of the print head. In the print head that ejects ink for printing, the printing properties are synonymous with the ink ejection properties. The predetermined parameter may be at least one of an environmental temperature and an environmental humidity. The technique of the present invention switches over the working driving waveform at high speed and enables the effects of the predetermined parameter to be quickly reflected on the driving waveform, thus improving the accuracy of dot creation and the picture quality of the resulting printed image.

In the case where the driving waveform is corrected with the predetermined parameter, the arrangement of the second embodiment discussed above is preferably adopted; namely the reading operation from one memory is carried out in parallel with the writing operation into the other memory. The arrangement of the first embodiment requires all the sets of driving waveform data to be provided in advance corresponding to the possible variation of the parameter. This needs an extremely large memory capacity. Restriction of the memory capacity leads to restriction of the number of corrected driving waveforms, which undesirably lowers the accuracy of correction with the parameter. The second embodiment, on the other hand, carries out the writing and reading operations in parallel and thus effectively saves the required memory capacity for the corrected driving waveforms. This ensures the accurate correction with the parameter without undue restriction of the memory capacity.

The technique of the present invention is actualized by a variety of applications including a method of generating a driving waveform, a driving waveform generating apparatus, and a printing apparatus.

These and other objects, features, aspects, and advantages of the present invention will become more apparent from the following detailed description of the preferred embodiments with the accompanying drawings.

DESCRIPTION OF THE PREFERRED EMBODIMENTS

Preferred embodiments of the present invention are described below in the following order:

A. First Embodiment

A1. Structure of Printing Apparatus

A2. Generation of Driving Waveform

A3. Driving Waveforms

A4. Switching Over of Driving Waveforms

B. Second Embodiment

B1. Structure of Driving Waveform Generating Apparatus

C. Third Embodiment

A. First Embodiment

A1. Structure of Printing Apparatus

Figure 2:
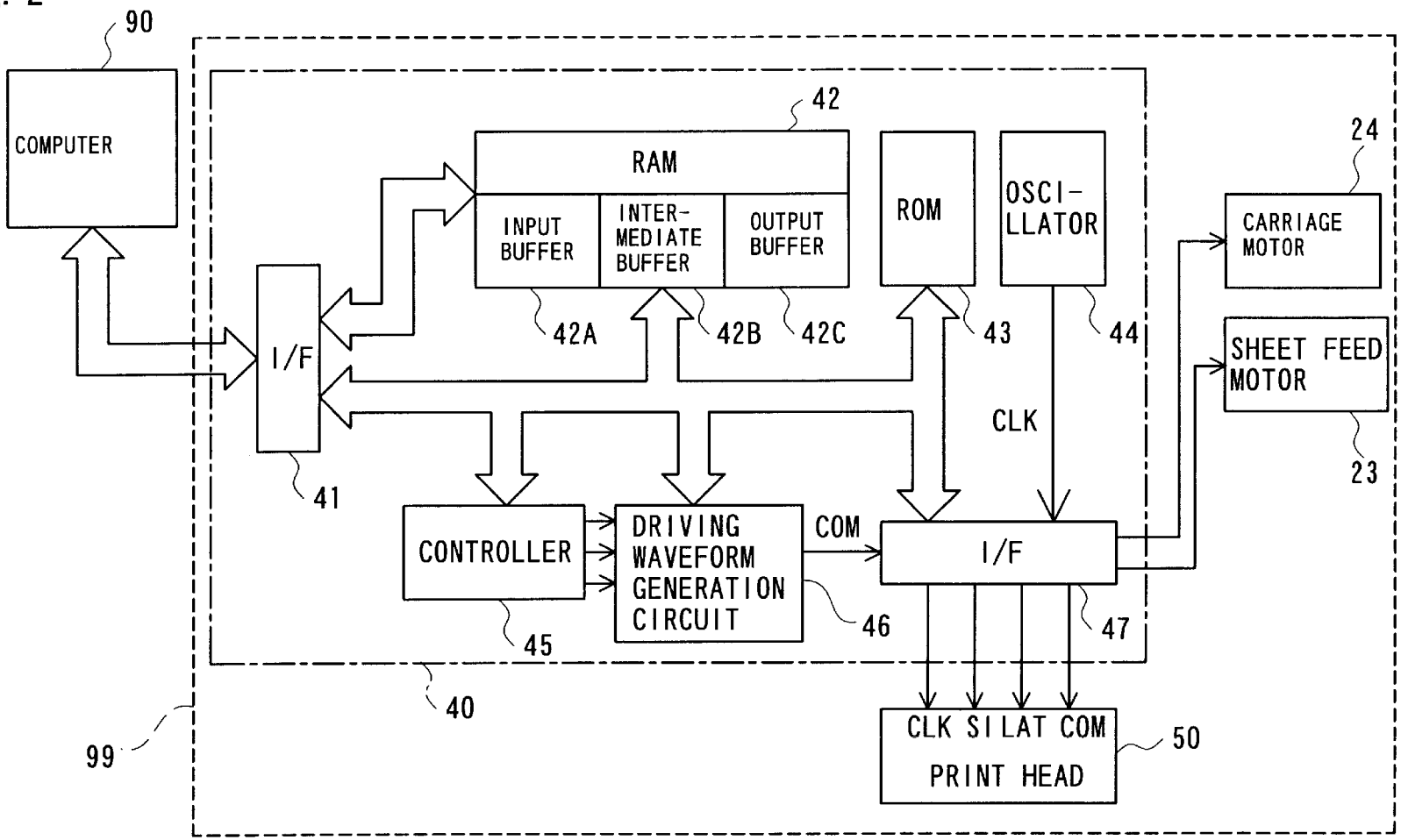
FIG. 2 is a block diagram illustrating the general structure of a printing apparatus in one embodiment of the present invention.

FIG. 2 is a block diagram illustrating the general structure of a printing apparatus in one embodiment of the present invention. The printing apparatus includes a computer 90 and a printer 99.

The computer 90 has a printer driver that is incorporated therein and works under a predetermined operating system. The printer driver outputs print signals to the printer 99 to print an image.

The printer 99 includes a control circuit 40, a sheet feed motor 23, a carriage motor 24 that carries out main scan, and a print head 50. The control circuit 40 includes an interface 41 that receives print signals from the computer 90, a RAM 42 that stores a variety of data therein, a ROM 43 that stores a diversity of routines used to process various data, an oscillator 44, a controller 45 including a CPU, a driving waveform generation circuit 46, and an interface 47 that sends the print signals and driving signals to the sheet feed motor 23, the carriage motor 24, and the print head 50.

The RAM 42 is divided into three parts, which are respectively used as an input buffer 42A, an intermediate buffer 42B, and an output buffer 42C. The print signals sent from the computer 90 are stored in the input buffer 42A via the interface 41. The input print signals are converted to intermediate codes and stored in the intermediate buffer 42B. The controller 45 carries out a series of required processing to develop dot pattern data by referring to font data and graphic functions in the ROM 43 and stores the dot pattern data in the output buffer 42C. The dot pattern data are sent to the print head 50 via the interface 47.

A variety of data to control the driving waveform generation circuit 46, for example, plural sets of driving waveform data and output timing data of the clock signal are stored in the ROM 43.

Figure 3:
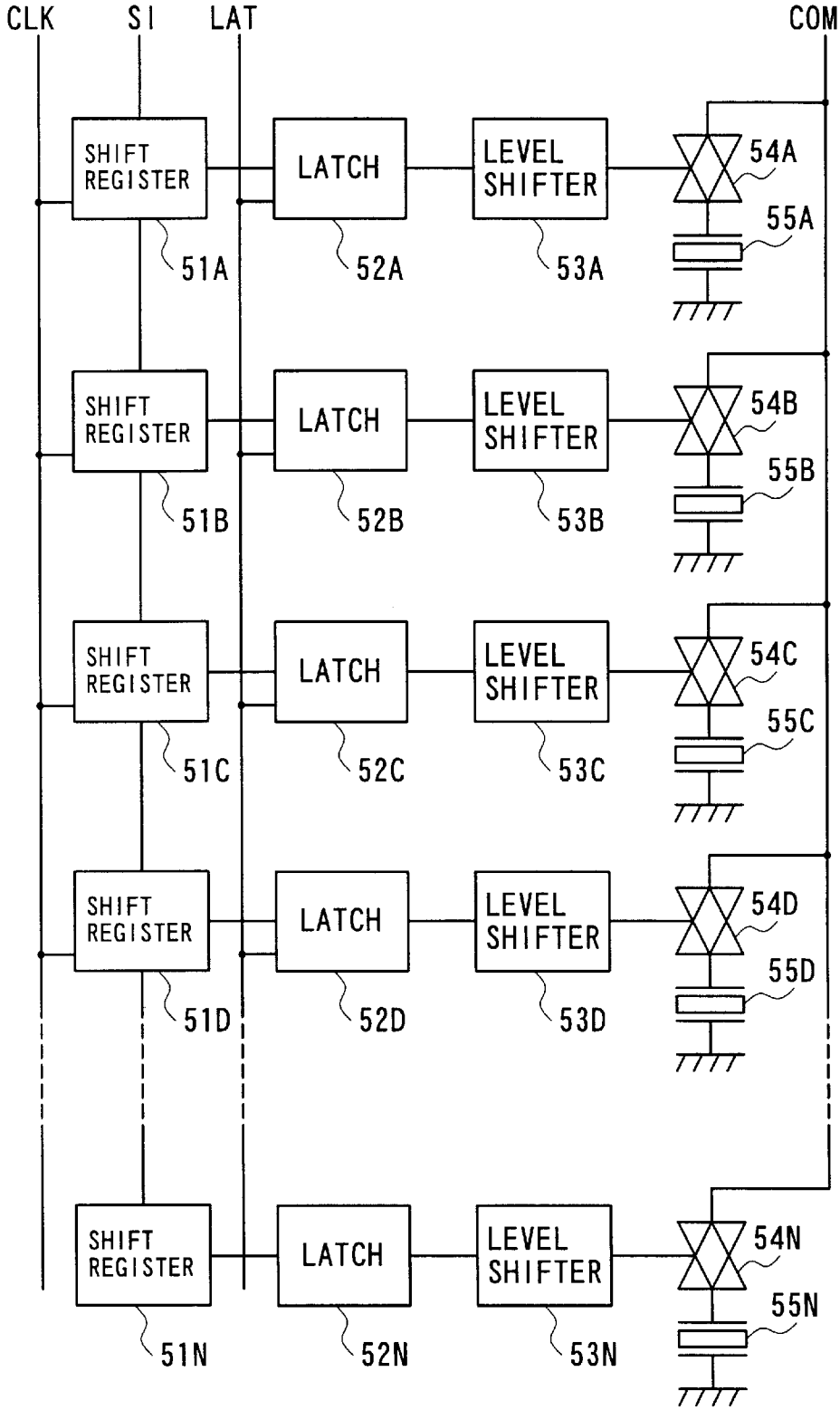
FIG. 3 is a block diagram illustrating the circuit structure of a print head included in the printing apparatus of FIG. 2.

FIG. 3 is a block diagram illustrating the circuit structure of the print head 50. The print head 50 includes a predetermined number, which is identical with the number of nozzles, of shit registers 51A through 51N, latch circuits 52A through 52N, level shifters 53A through 53N, switching circuits 54A through 54N, and piezoelectric elements 55A through 55N.

A print signal SI, that is, a signal representing dot on-off state of each pixel, is input into the shift registers 51A through 51N in synchronism with a clock signal CLK and latched by the latch circuits 52A through 52N in synchronism with a latch signal LAT. The latched print signal SI is amplified by the level shifters 53A through 53N to a drivable voltage level that is able to drive the switching circuits 54A through 54N, and is supplied to the switching circuits 54A through 54N. The input terminals of the switching circuits 54A through 54N receive a driving signal COM output from the driving waveform generation circuit 46, whereas the output terminals thereof are connected with the piezoelectric elements 55A through 55N. The piezoelectric elements 55A through 55N are disposed adjacent to ink conduits of the respective nozzles.

In response to the print signal SI, the switching circuits 54A through 54N allow and block the supply of the driving signal COM to the piezoelectric elements 55A through 55N. For example, in the case where the print signal SI is equal to a value '1', the supply of the driving signal COM to the piezoelectric elements is allowed. In the case where the print signal SI is equal to a value '0', on the other hand, the supply of the driving signal COM to the piezoelectric elements is blocked. Hereinafter the latter process is called masking. In response to the supply of the driving signal COM to the piezoelectric elements 55A through 55N, the piezoelectric elements 55A through 55N are deformed to allow ejection of ink droplets.

A2. Generation of Driving Waveform

Figure 4:
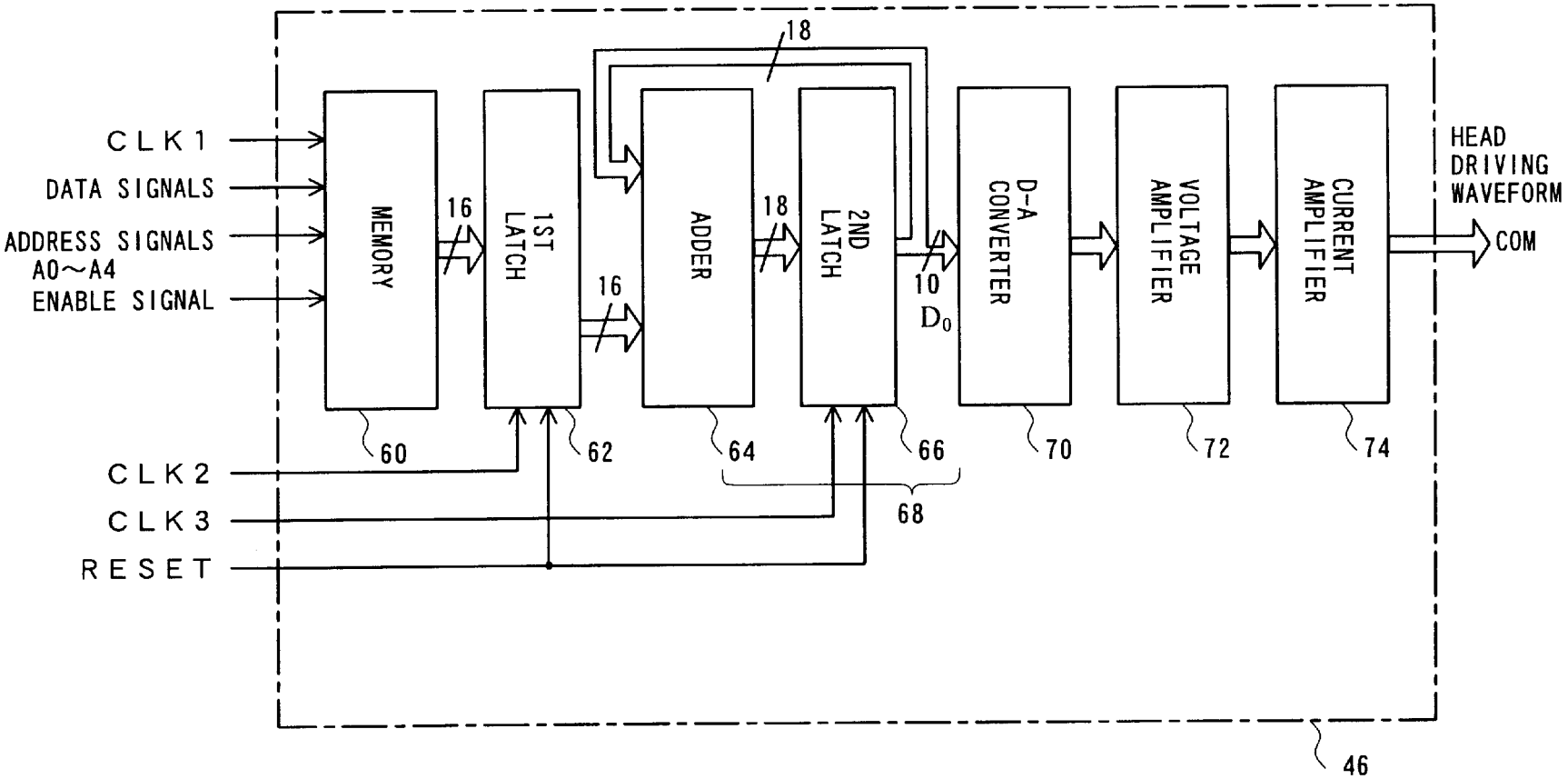
FIG. 4 is a block diagram illustrating the internal structure of a driving waveform generation circuit included in the printing apparatus of FIG. 2.

FIG. 4 is a block diagram illustrating the internal structure of the driving waveform generation circuit 46. A memory 60 stores driving waveform data output from the controller 45. A first latch 62 temporarily stores the driving waveform data read from the memory 60. An adder 64 and a second latch 66 constitute an accumulator 68 that accumulate the driving waveform data. More specifically the adder 64 sums up the outputs of the first latch 62 and the second latch 66 and outputs the result of addition to the second latch 66. The value of the second latch 66 is thus successively updated to the newest result of accumulation. The arithmetic operation gives 18-bit data as the result of accumulation. A digital-to-analog (D-A) converter 70 carries out D-A conversion of the output of the second latch 66. A voltage amplifier 72 amplifies the converted analog signal to a voltage level that enables actuation of the piezoelectric elements. A current amplifier 74 supplies electric current of a specific level that is required for driving the plural piezoelectric elements.

Figure 1A:
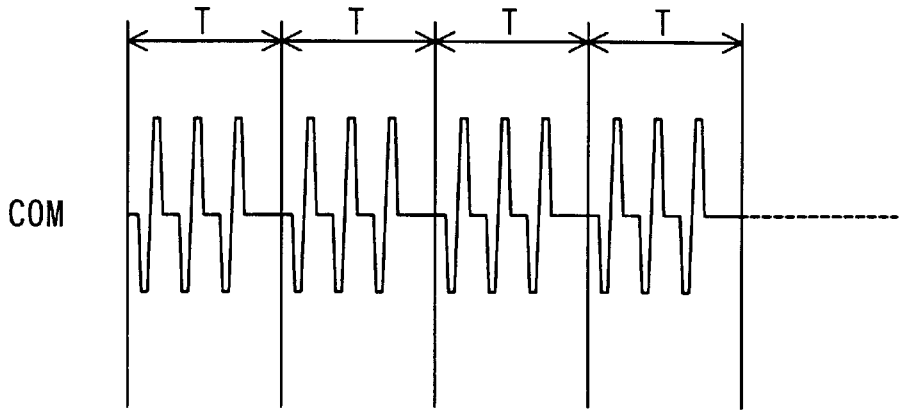
FIGS. 1A and 1B show the relationship between one interval of a driving waveform and a pixel.
Figure 1B:
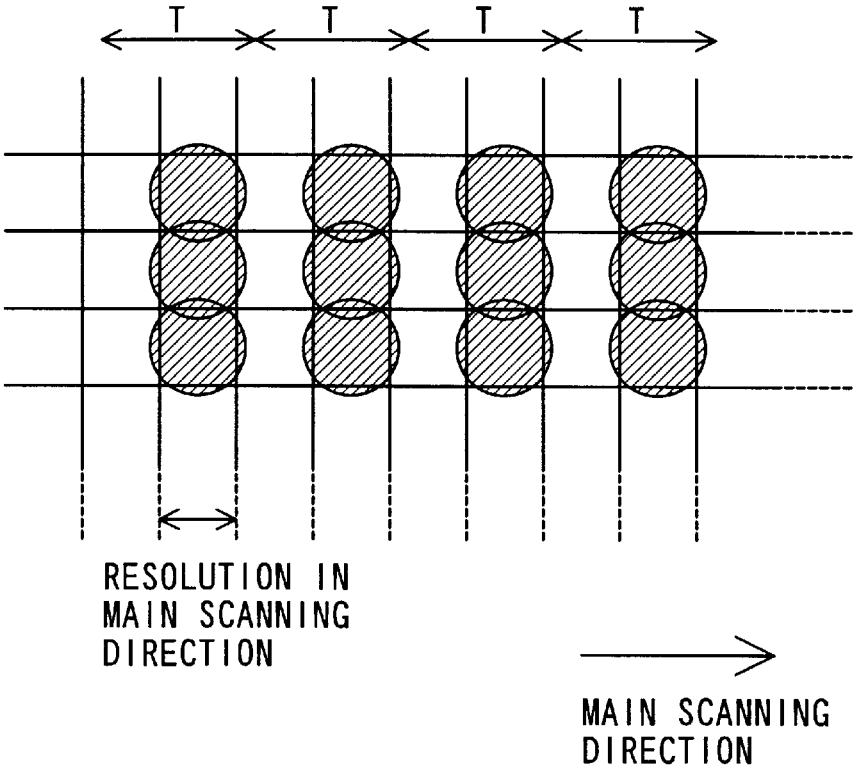

A variety of signals are supplied from the controller 45 to the driving waveform generation circuit 46. A first clock signal CLK1, data signals representing the driving waveform data, address signals A0 through A4, and an enable signal EN are supplied to the memory 60. The first clock signal CLK1 synchronizes data transfer to the memory 60. The first latch 62 receives a second clock signal CLK2 and a reset signal RESET. The second clock signal CLK2 synchronizes data latching in the first latch 62. The second latch 66 receives a third clock signal CLK3 and the reset signal RESET. The third clock signal CLK3 synchronizes the arithmetic operation carried out by the accumulator 68. The same reset signal RESET is supplied to both the first and the second latches 62 and 66. The driving waveform generation circuit 46 of this configuration functions, in combination with the controller 45, the RAM 42, and the ROM 43 shown in FIG. 1, as a driving waveform generating apparatus.

Figure 5:
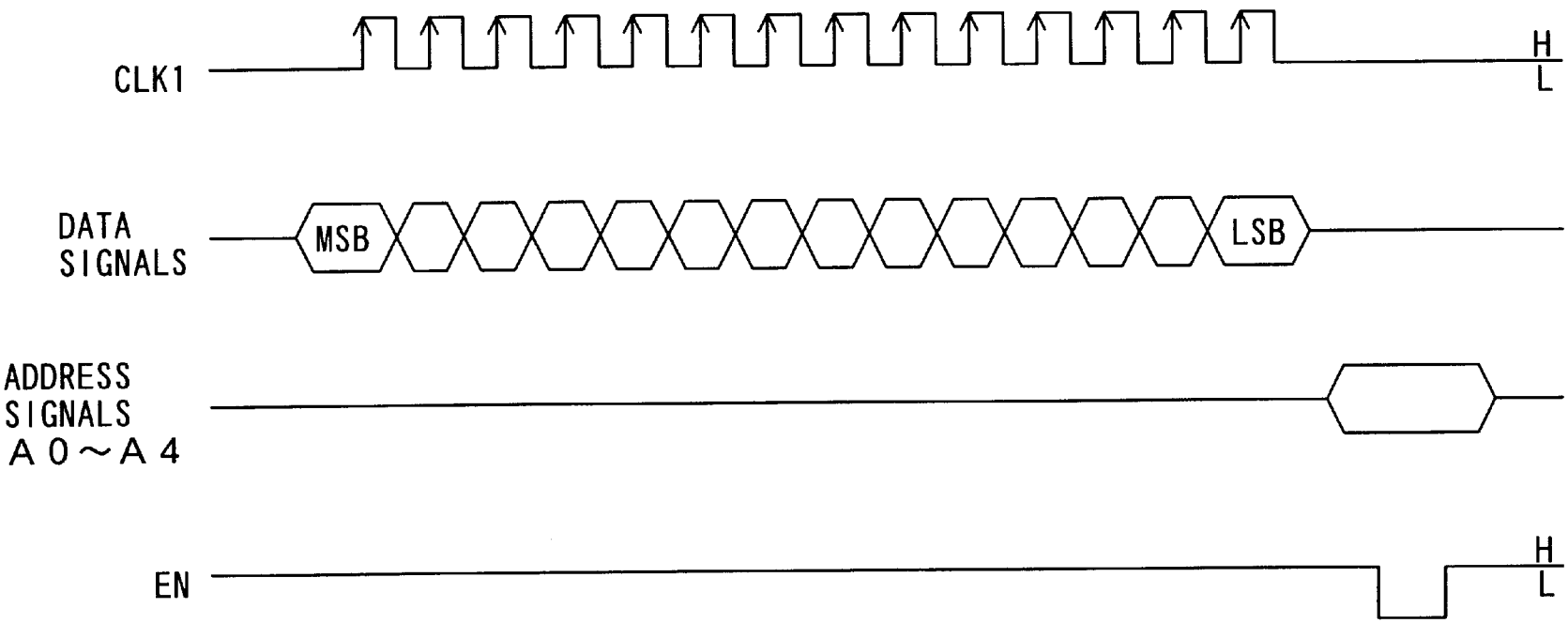
FIG. 5 is a timing chart showing timings of writing driving waveform data into a memory.

FIG. 5 is a timing chart showing timings of writing the driving waveform data into the memory. Prior to generation of the driving waveform COM, the data signals representing the driving waveform data and the addresses of the data signals are supplied from the controller 45 to the memory 60. The driving waveform data are serially transferred bit by bit in synchronism with the first clock signal CLK1. After the transfer of the driving waveform data, the address signals A0 through A4 are supplied with the enable signal EN. The driving waveform data is written at the address specified by the address signals A0 through A4 in the memory 60 at the input timing of the enable signal EN. Since the address signals A0 through A4 constitute 5-bit data, 32 pieces of driving waveform data at the maximum may be stored in the memory 60.

Figure 6:
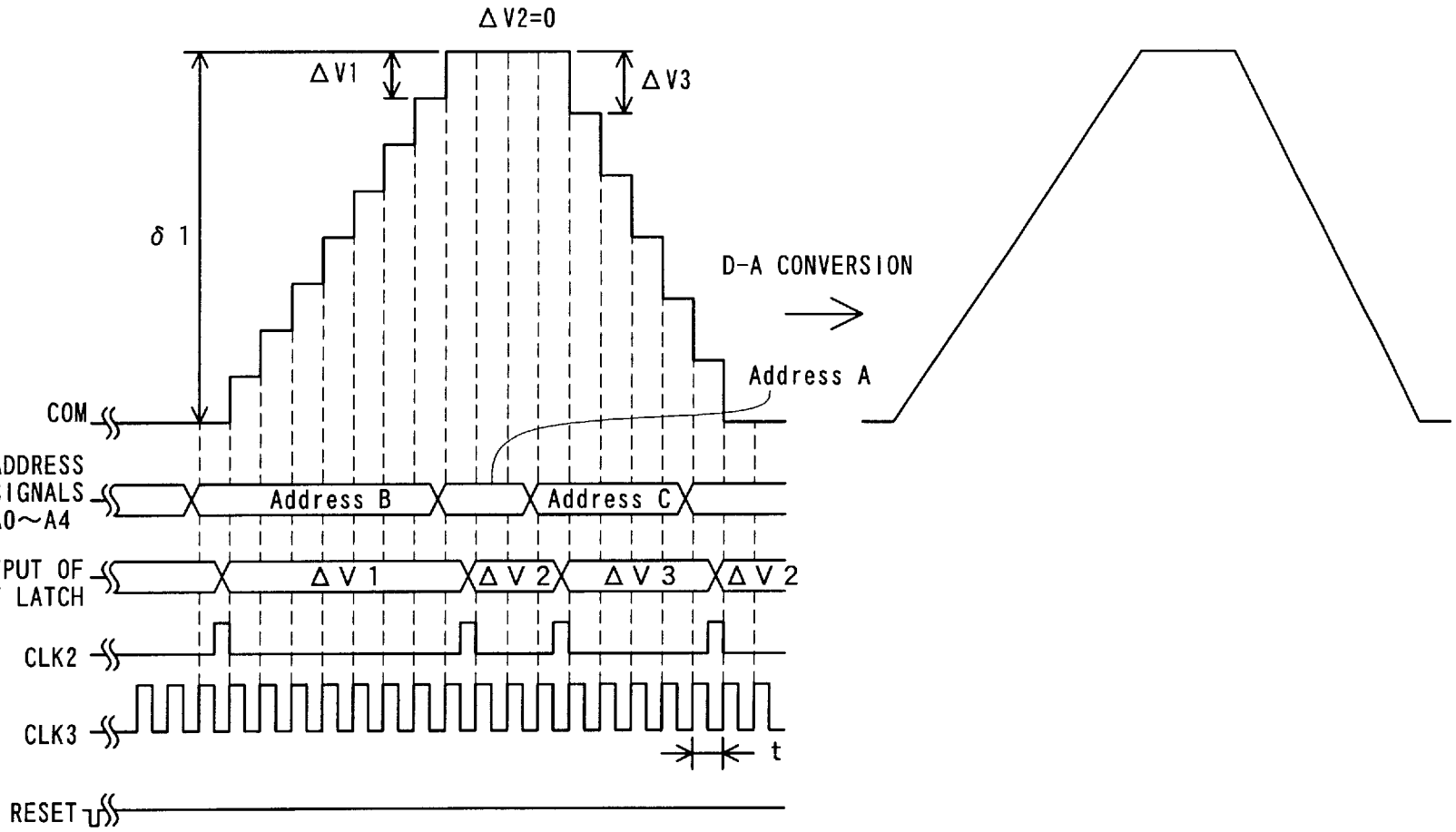
FIG. 6 shows a process of generating a driving waveform.

FIG. 6 shows a process of generating a driving waveform. In the example of FIG. 6, it is assumed that driving waveform data ΔV1, ΔV2, and ΔV3 are respectively written at addresses B, A, and C. The driving waveform data is 16-bit data representing a quantity of voltage change per interval t of the third clock signal CLK3.

The first driving waveform data ΔV1 is output from the memory 60 in response to the output of the address B and is latched by the first latch 62 in synchronism with the second clock signal CLK2. The adder 64 sums up the 18-bit output of the second latch 66 and the 16-bit output of the first latch 62 in synchronism with the third clock signal CLK3. The result of the summation is kept in the second latch 66. In response to every pulse of the third clock signal CLK3, the value of the driving waveform data is added to the output of the second latch 66. The voltage of the driving waveform accordingly rises by ΔV1. The interval of generating the pulse of the third clock signal CLK3 may be varied to attain a desired accumulation timing.

In synchronism with the next pulse of the clock signal CLK2, the driving waveform data ΔV2 specified by the address signal A is latched by the first latch 62. In the example of FIG. 6, ΔV2=0, that is, the value indicative of no change of the voltage, is set as the driving waveform data. While the driving waveform data ΔV2 is output, the waveform of the driving signal is plateau. After the output of the subsequent pulse of the clock signal CLK2, the driving waveform is generated with the driving waveform data ΔV3. In the example of FIG. 6, the driving waveform data ΔV3 has a negative value. While the driving waveform data ΔV3 is output, the voltage gradually decreases. The increase and the decrease in voltage depend upon the plus and minus signs of the driving waveform data.

As shown in FIG. 4, the 18-bit result of addition summed up by the adders 64 is again input into the adder 64. Voltage level data D0 output from the second latch 66 accordingly varies stepwise as shown in FIG. 6. The upper 10 bits of the voltage level data D0 are subjected to the D-A conversion carried out by the D-A converter 70 to generate a driving waveform shown on the right side of FIG. 6.

A3. Driving Waveforms

Figure 7A:
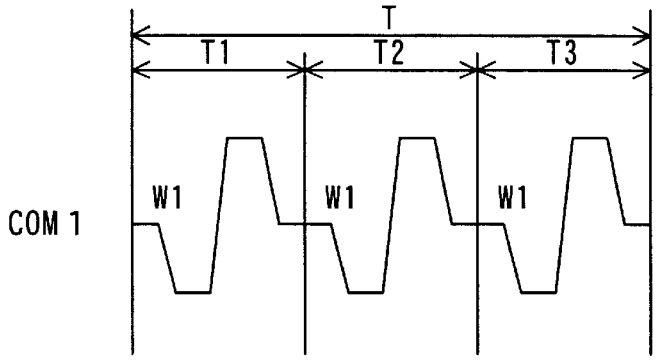
FIGS. 7A through 7D show settings of a driving waveform for multi-shot dots (MS)

This embodiment selectively uses two different driving waveforms to create dots. FIGS. 7A through 7D show dot formation with a first driving waveform COM1. As shown in FIG. 7A, the driving waveform COM1 has three identical element waveforms W1 in three divisions T1 through T3 included in one pixel division T.

Figure 7B:
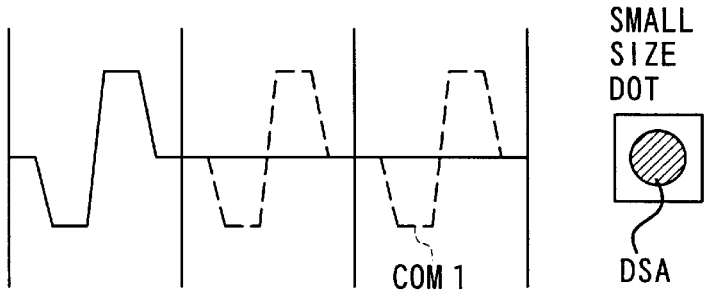

As shown in FIG. 7B, when the switching circuit 54 is controlled to mask the element waveforms W1 in the divisions T2 and T3, an ink droplet is ejected in response to only the first element waveform W1 in the division T1 to create a small size dot DSA.

Figure 7C:
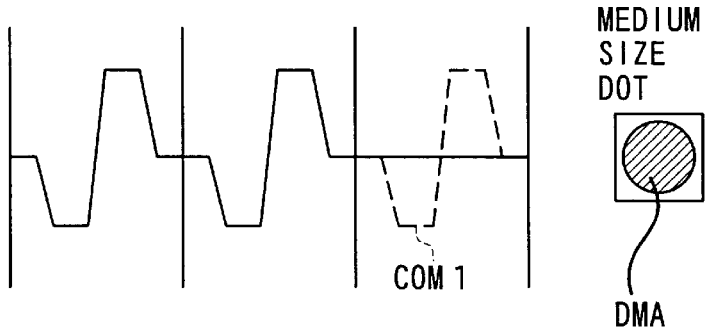

As shown in FIG. 7C, when the switching circuit 54 is controlled to mask the third element waveform W1 in the division T3, ink droplets are ejected in response to the first two element waveforms W1 in the divisions T1 and T2 to create a medium size dot DMA. The medium size dot DMA is formed with the quantity of ink approximately double the quantity of ink of the small size dot DSA.

Figure 7D:
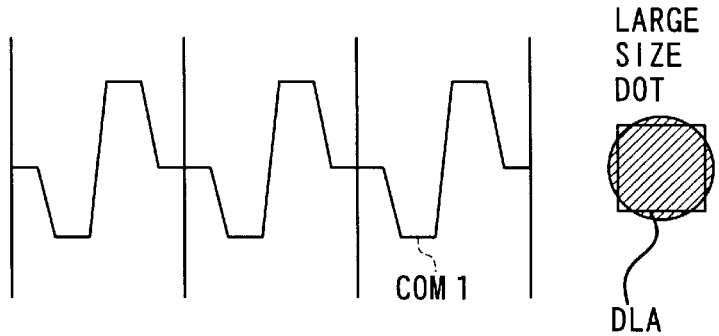

As shown in FIG. 7D, in response to the three element waveforms W1 in all the divisions T1, T2, and T3, a large size dot DLA having the quantity of ink three times of the quantity of ink of the small size dot DSA is created.

The three different dots created in response to the first driving waveform COM1 shown in FIGS. 7A through 7D are referred to as multi-shot dots MS.

Figure 8A:
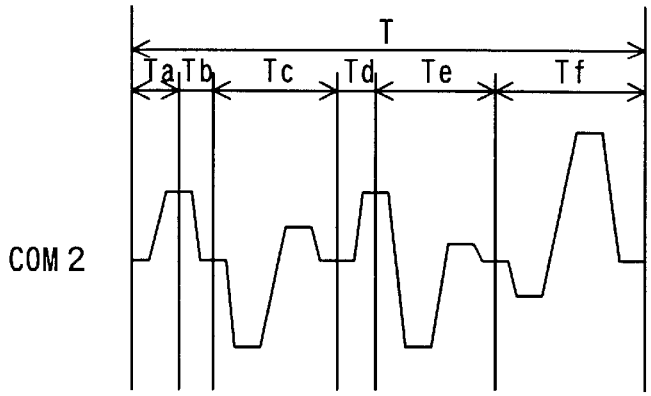
FIGS. 8A through 8D show settings of a driving waveform for variable size dots (VSD)

FIGS. 8A through 8D show dot formation with a second driving waveform COM2. As shown in FIG. 8A, the driving waveform COM2 has a plurality of waveforms in one pixel division T. For convenience of explanation, one pixel division is divided into sections Ta through Tf.

Figure 8B:
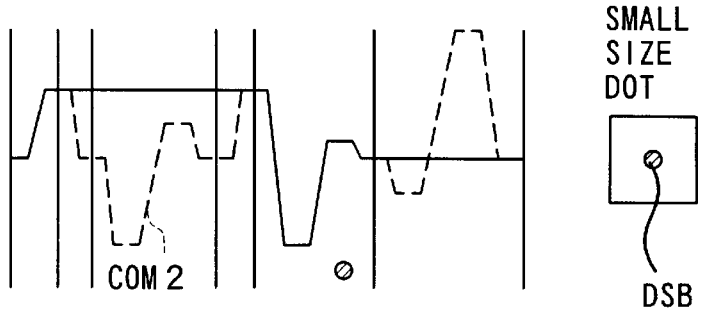

FIG. 8B shows formation of a small size dot with the second driving waveform COM2. The switching circuit 54 (see FIG. 2) is controlled on in the sections Ta and Te of the second driving waveform COM2, while being controlled off in the other sections. In the sections where the switching circuit 54 is off, the electric charge is practically kept unchanged because the piezoelectric element 55 acts as a capacitor. The driving waveform substantially similar to the illustration is accordingly supplied to the piezoelectric element 55 to eject an ink droplet having the quantity of ink according to the supplied driving waveform and create a small size dot DSB.

Figure 8C:
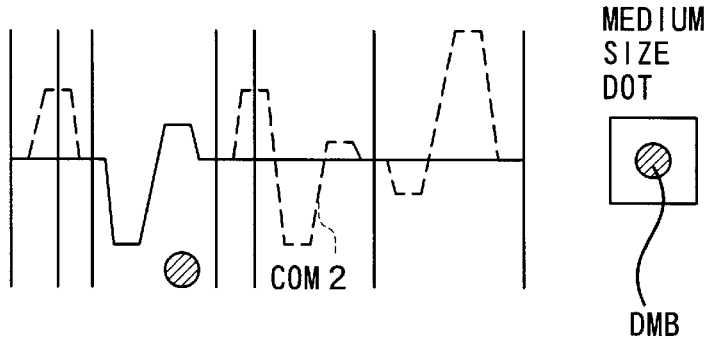

FIG. 8C shows formation of a medium size dot with the second driving waveform COM2. The switching circuit 54 is controlled on in the section Tc of the second driving waveform COM2, while being controlled off in the other sections. This gives an illustrated driving waveform. The print head 50 ejects an ink droplet having the quantity of ink according to this driving waveform and creates a medium size dot DMB.

Figure 8D:
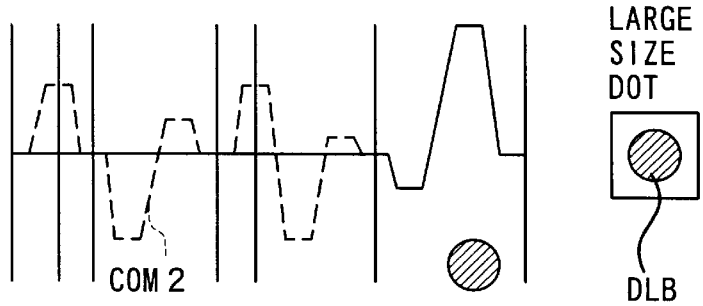

FIG. 8D shows formation of a large size dot with the second driving waveform COM2. The switching circuit 54 is controlled on in the section Tf of the second driving waveform COM2, while being controlled off in the other sections. This gives an illustrated driving waveform. The print head 50 ejects an ink droplet having the quantity of ink according to this driving waveform and creates a large size dot DLB.

The three different dots created using the second driving waveform COM2 shown in FIGS. 8A through 8D are referred to as variable size dots (VSD).

The quantities of ink may set independently for the three multi-shot dots DSA, DMA, and DLA and for the three variable size dots DSB, DMB, and DLB. The technique of this embodiment selectively uses the driving waveform COM1 for the multi-shot dots and the driving waveform COM2 for the variable size dots, so as to enable creation of six different dots.

A4. Switching Over of Driving Waveforms

Figure 9:
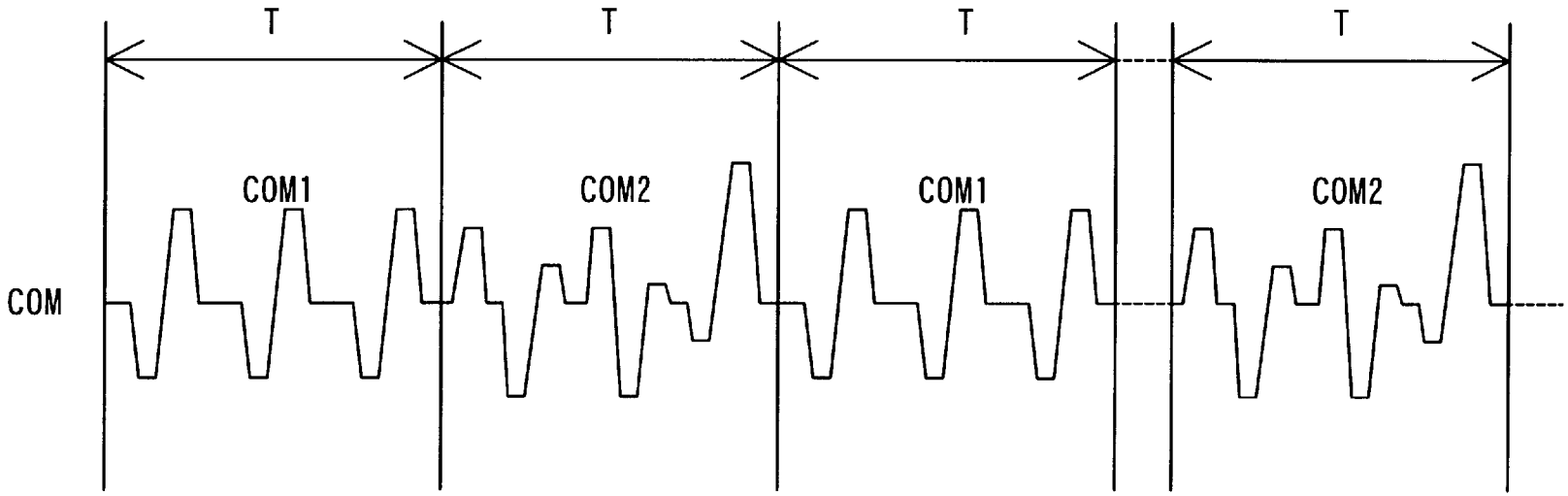
FIG. 9 shows an example of switchover between two different driving waveforms.

FIG. 9 shows an example of switchover between two different driving waveforms. The driving waveforms COM1 and COM2 are alternately switched over at every interval T of the driving waveform, which corresponds to one pixel division.

The switchover is performed in the following manner. All the pieces of the driving waveform data required for generation of the two driving waveforms COM1 and COM2 are stored in the memory 60. The controller 45 changes over the address signal output to the memory 60 according to the type of the driving waveform to be output to each pixel, so as to switch over the resulting driving waveform. In the example of FIG. 9, the driving waveforms COM1 and COM2 are output alternately. The driving waveform may be switched over according to a preset pattern or according to the type of the dot to be created at each pixel. The driving waveform COM1 is used at the pixels where any of the multi-shot dots DSA, DMA, and DLA is to be created. The driving waveform COM2 is used at the pixels where any of the variable size dots DSB, DMB, and DLB is to be created.

The technique of this embodiment changes over the driving waveform data used for generation of the driving waveform, so as to vary the resulting driving waveform. The selective use of the plurality of different driving waveforms enables a greater number of different types of dots to be used for printing, compared with the prior art technique that uses only a single driving waveform. This results in improved tone reproduction of the printed images.

Figure 10:
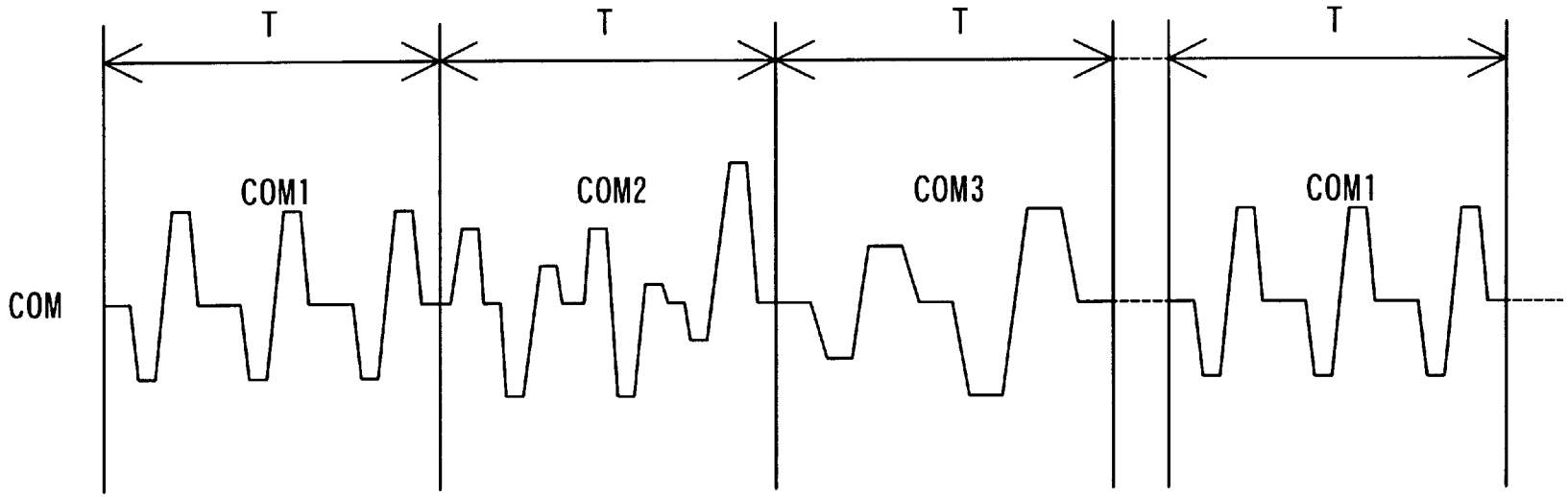
FIG. 10 shows an example of switchover among three different driving waveforms.

The arrangement of the embodiment may use three or more sets of driving waveform data. FIG. 10 shows an example of switchover among three different driving waveforms. In the example of FIG. 10, three driving waveforms COM1, COM2, and COM3 are successively switched over for every interval T of the driving waveform corresponding to one pixel division. In this case, the driving waveform data are appropriately selected according to the type of the dot to be created at each pixel. A further increase in the number of different driving waveforms additionally increases the number of different types of dots usable for printing.

B. Second Embodiment

Figure 11:
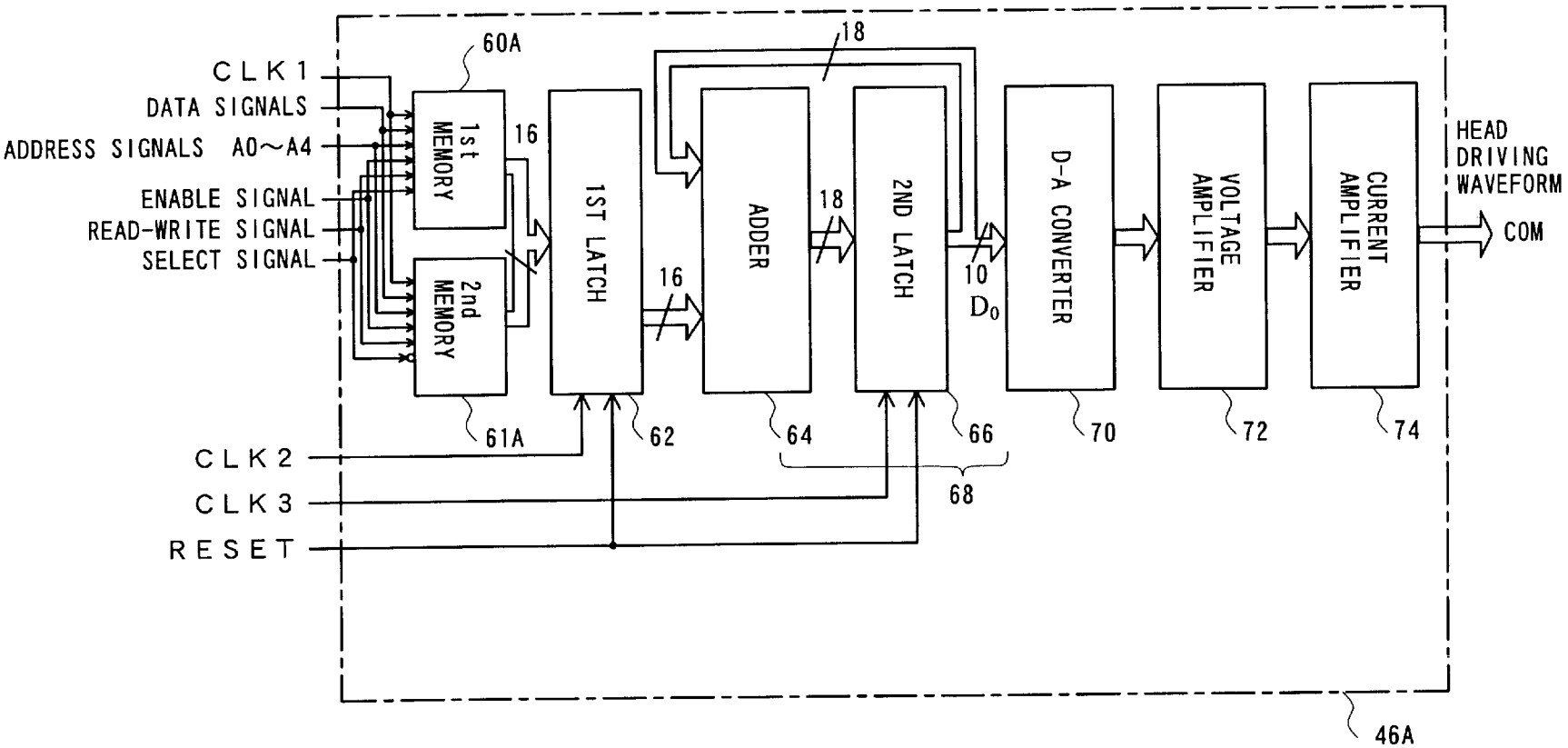
FIG. 11 is a block diagram illustrating the internal structure of a driving waveform generation circuit in a second embodiment of the present invention.

FIG. 11 is a block diagram illustrating the internal structure of a driving waveform generation circuit 46A in a second embodiment of the present invention. The primary difference from the circuit 46 of the first embodiment is that the circuit 46A of the second embodiment has two memories 60A and 61A to store the driving waveform data, instead of only one memory 60. The other constituents of the driving waveform generation circuit 46A are identical with those of the first embodiment. The same signals as those supplied to the memory 60 of the first embodiment are supplied respectively to these two memories 60A and 61A. A read-write signal R/W and a select signal CS are additionally supplied to the two memories 60A and 61A. The select signal CS supplied to the first memory 60A is inverted to be supplied to the second memory 61A.

Figure 12A:
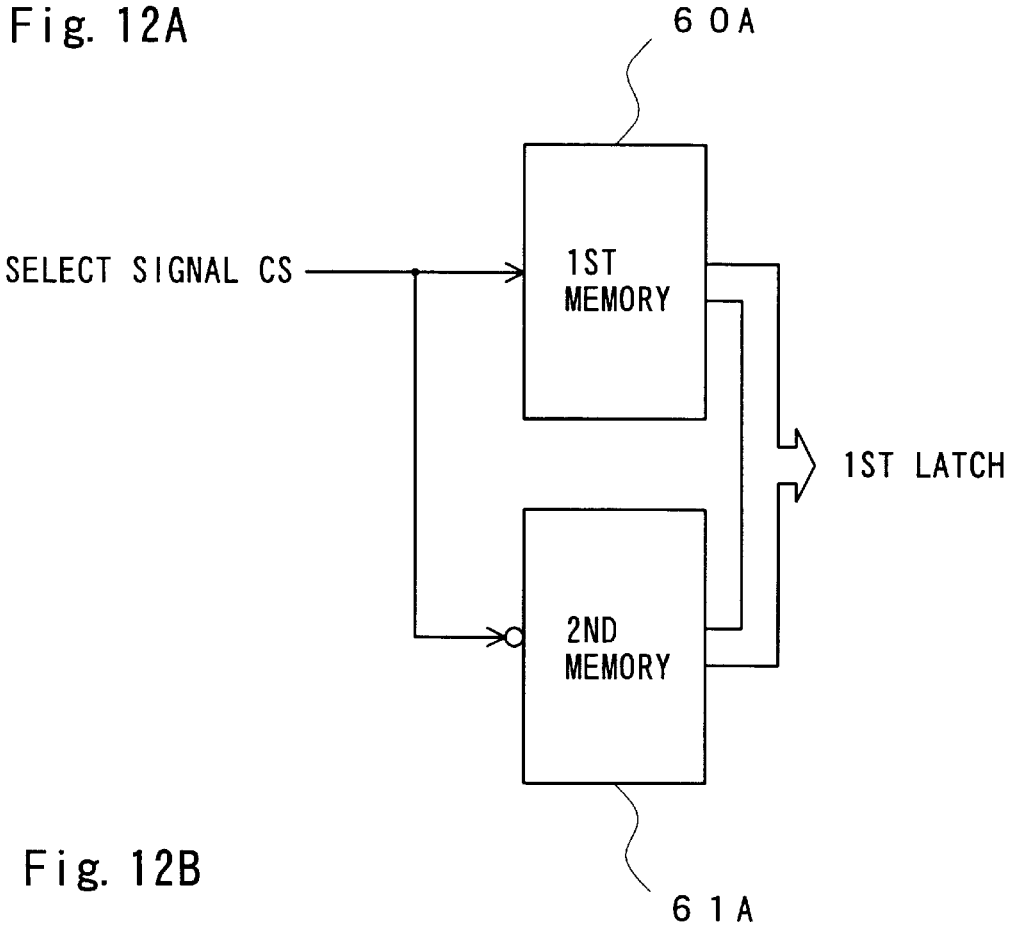
FIGS. 12A and 12B show a process of switchover between a reading operation from one memory and a writing operation from the other memory.
Figure 12B:
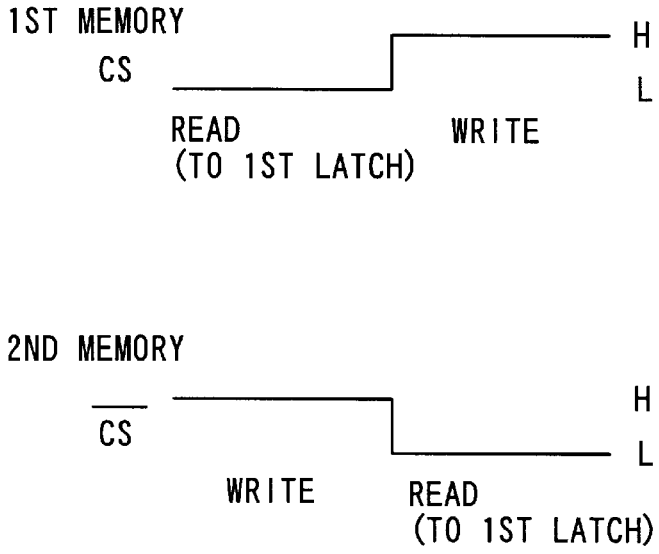

FIGS. 12A and 12B show a process of switchover between a reading operation from one memory and a writing operation from the other memory. The operations of the two memories 60A and 61A are controlled by the select signal CS. As shown in FIG. 12A, the select signal CS is directly supplied to the first memory 60A, while being inverted and supplied to the second memory 61A. Referring to FIG. 12B, when the select signal CS is at a low level L, the first memory 60A undergoes the reading operation and the second memory 61A undergoes the writing operation. When the select signal CS is at a high level H, on the other hand, the first memory 60A undergoes the writing operation and the second memory 61A undergoes the reading operation. The driving waveform data are written into each of the two memories according to the same procedures as those discussed in the first embodiment (see FIG. 5).

Figure 13:
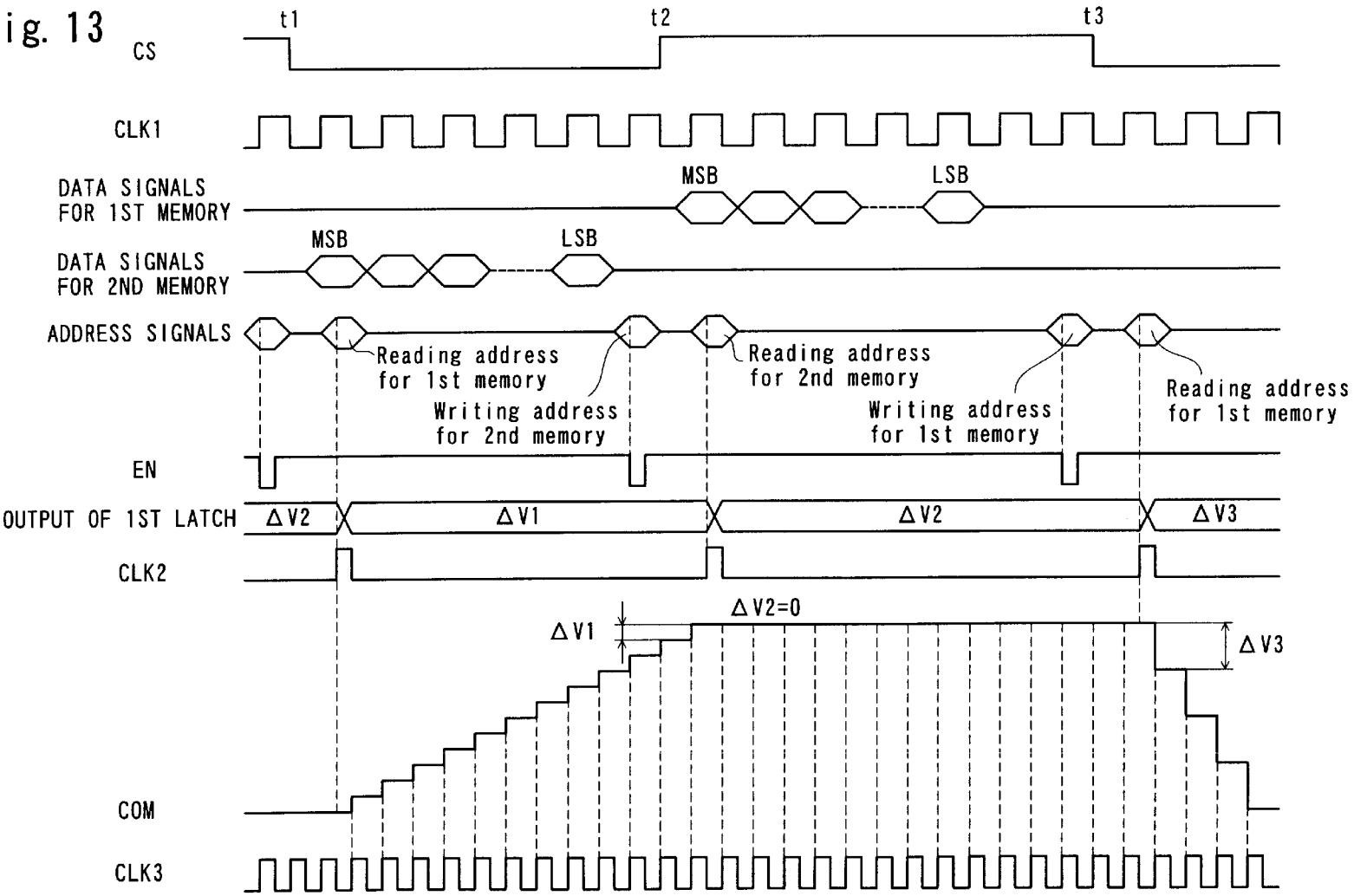
FIG. 13 shows a process of generating a driving waveform in the second embodiment.

FIG. 13 shows a process of generating a driving waveform in the second embodiment. The technique of the second embodiment selectively uses the two memories 60A and 61A for different operations in the process of generating the driving waveform.

When the select signal CS is at the level L, for example, in a time interval between time points t1 and t2 and a time interval after a time pint t3, the first memory 60A functions as a reading memory and the second memory 61A functions as a writing memory. In these time intervals, the driving waveform is generated by successively accumulating the data of the first memory 60A. The accumulation is carried out in synchronism with the third clock signal CLK3. In a time interval before the time point t1 and a time interval between the time points t2 and t3 when the select signal CS is at the level H, the first memory 60A functions as a writing memory and the second memory 61A functions as a reading memory. In these time intervals, the driving waveform is generated by using the data of the second memory 61A.

The following describes the operations carried out in the time interval between the time points t1 and t2. Driving waveform data ΔVI has been stored in advance in the first memory 60A. When the address signals A0 through A4 are supplied to specify a reading address for the first memory 60A, the driving waveform data ΔV1 is read from the first memory 60A and latched by the first latch 62 in synchronism with the second clock signal CLK2. The adder 64 subsequently sums up the 18-bit output of the second latch 66 and the 16-bit output of the first latch 62 synchronously with the third clock signal CLK3. The result of the summation is again latched by the second latch 66. As shown in the lower portion of FIG. 13, the value of the driving waveform data ΔV1 is added to the output of the second latch 66 in response to every pulse of the third clock signal CLK3. The frequency of the third clock signal CLK3 may be varied to ensure a desired accumulation timing. In this time interval, in parallel with this reading operation, driving waveform data ΔV2 is written into the second memory 61A.

In the time interval between the time points t2 and t3, the first memory 60A and the second memory 61A exchange their functions. In this time interval, when the address signals A0 through A4 are supplied to specify a reading address for the second memory 61A, the driving waveform data ΔV2 is read from the second memory 61A and latched by the first latch 62 in synchronism with the second clock signal CLK2. In this time interval, the driving waveform data ΔV2 is successively accumulated to generate the driving waveform. In the example of FIG. 13, the value of the driving waveform data ΔV2 is equal to zero, which represents no change of the voltage. The resulting driving waveform in this time interval is accordingly plateau. In this time interval, in parallel with this reading operation, driving waveform data ΔV3 is written into the first memory 60A.

In the time interval after the time point t3, the first memory 60A and the second memory 61A again exchange their functions. In the same manner as discussed above with regard to the time interval between the time points t1 and t2, the driving waveform is generated by accumulation of the driving waveform data ΔV3 stored in the first memory 60A. In the example of FIG. 13, the driving waveform data ΔV3 has a negative value. In this time interval, the driving waveform accordingly has a decreasing voltage by ΔV3. In this manner, the variation in voltage depends upon the sign of the data stored at each address.

The 18-bit result of the summation is input again into the adder 64. The voltage level data D0 output from the second latch 66 accordingly varies stepwise as shown in FIG. 13. The upper 10-bit voltage level data D0 out of the 18-bit result of the summation is input into the D-A converter 70 and subjected to the D-A conversion to generate the driving waveform COM.

The driving waveform generating apparatus of the second embodiment selectively uses the two memories 60A and 61A to alternately carry out the reading and writing operations. The selective use of the two memories 60A and 61A enables the reading operation to be carried out in parallel with the writing operation. The example of FIG. 13 uses the two memories 60A and 61A in combination to generate one driving waveform. One possible modification writes two different groups of driving waveform data into the respective memories 60A and 61A and selectively uses the two memories 60A and 61A to change over the working driving waveform.

Figure 14:
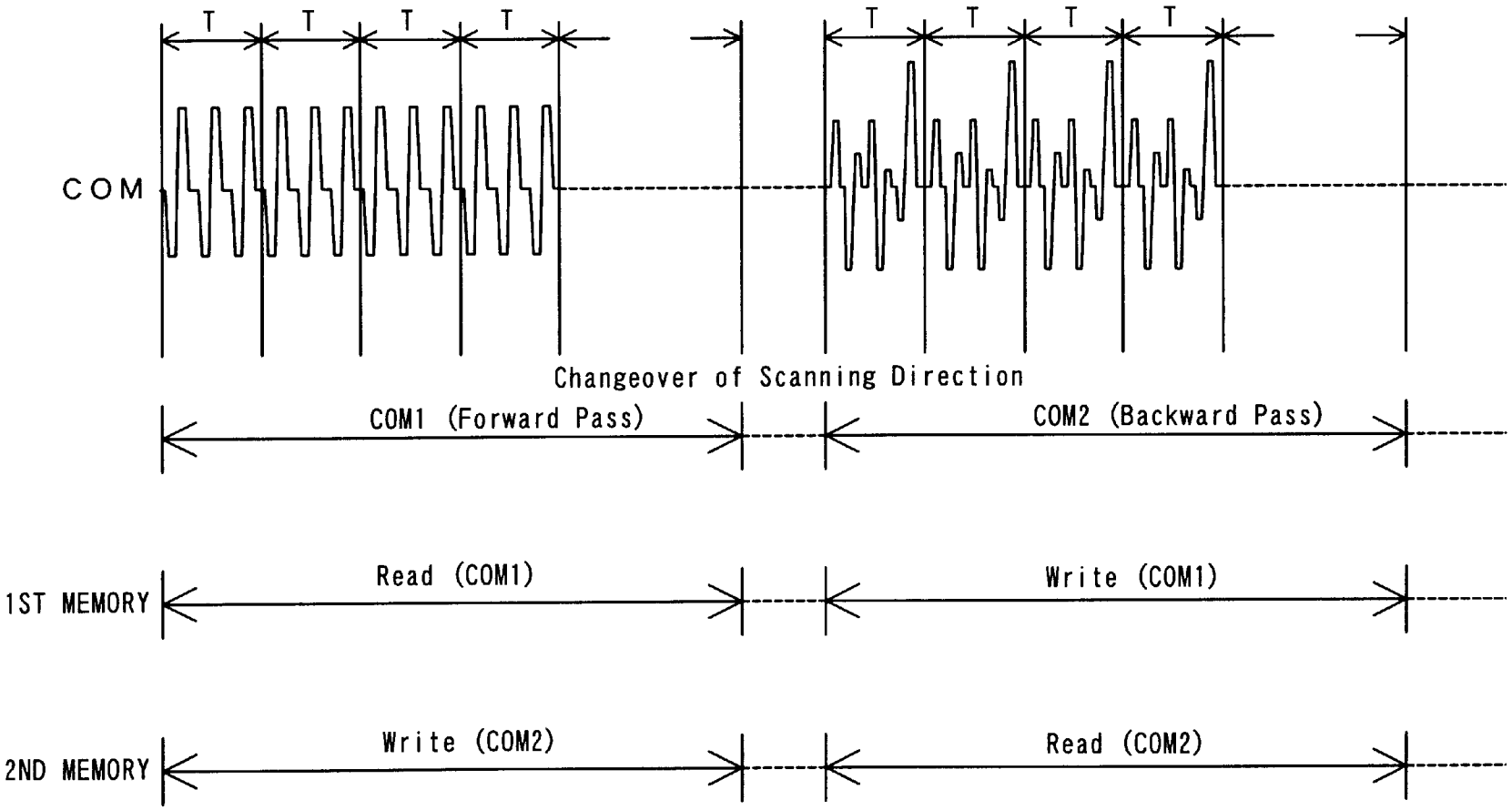
FIG. 14 shows an example of switchover timing of the working driving waveform.

FIG. 14 shows another example of switchover timing of the working driving waveform. In the example of FIG. 14, two driving waveforms COM1 and COM2 are selectively used for the forward pass and the backward pass of the main scan. The driving waveforms COM1 and COM2 are identical with those discussed in the first embodiment. In the forward pass of the main scan, the first set of driving waveform data are read from the first memory 60A to generate the first driving waveform COM1. In parallel with this reading operation, the second set of driving waveform data for the second driving waveform COM2 are written into the second memory 61A. In the backward pass of the main scan, the second set of driving waveform data are used from the second memory 61A to generate the driving waveform COM2. In parallel with this reading operation, the first set of driving waveform data for the first driving waveform COM1 are written into the first memory 60A.

The example of FIG. 14 switches over the working driving waveform between the forward pass and the backward pass of the main scan, so as to enable creation of six different types of dots. This arrangement effectively enhances the printing quality. The alternate use of the two memories 60A and 61A advantageously prevents the printing speed from being lowered by the switchover of the driving waveform. In the structure using a single memory, it is required to wait for completion of the writing operation of the driving waveform data into the memory on every occasion of switching from the forward pass to the backward pass or from the backward pass to the forward pass. The arrangement of this embodiment does not require such waiting time.

Figure 15:
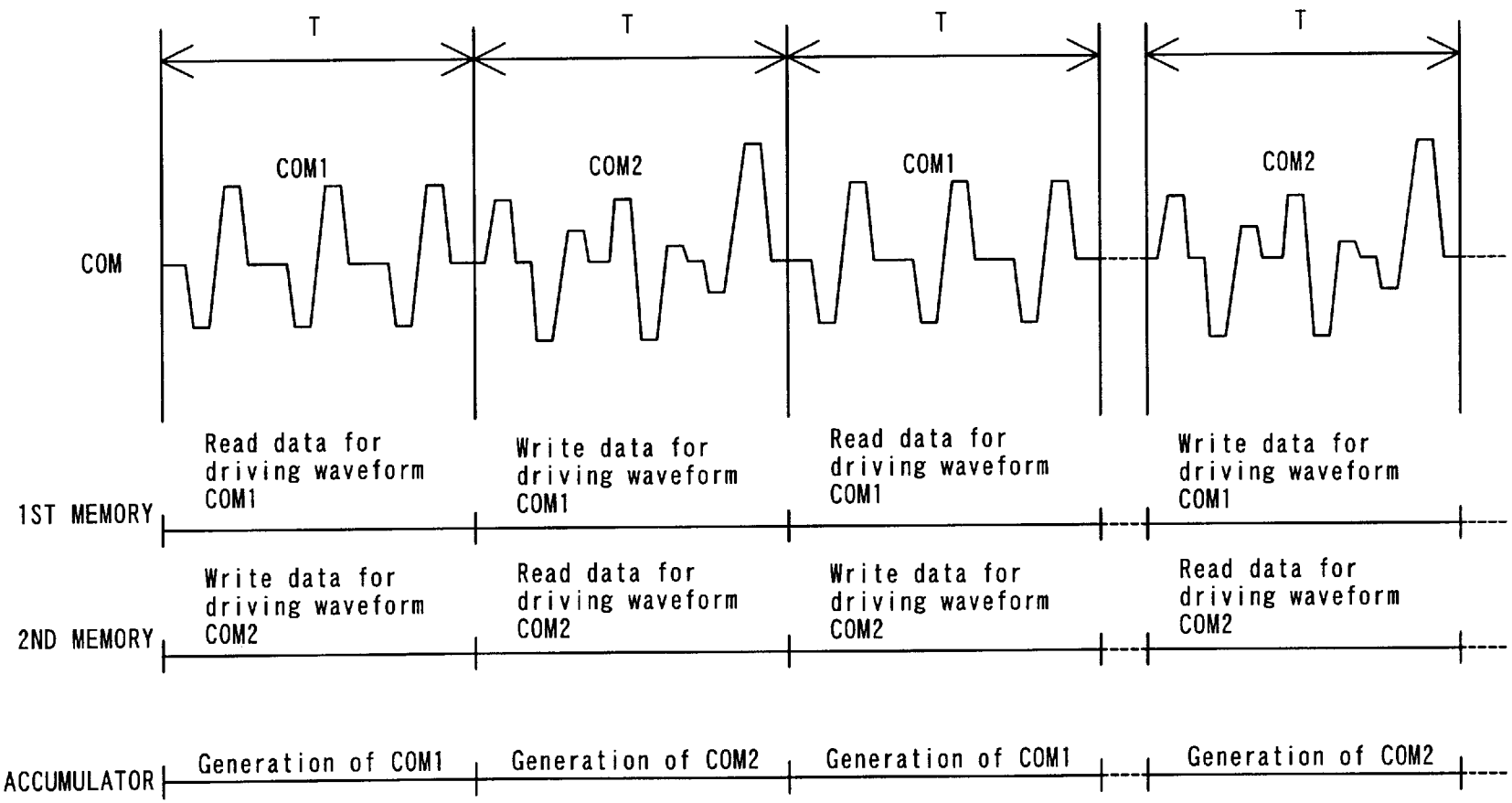
FIG. 15 shows another example of switchover timing of the working driving waveform.

FIG. 15 shows another example of switchover timing of the working driving waveform. In the example of FIG. 15, the driving waveform is changed over for every interval according to the requirements. The reading operation from one memory is carried out in parallel with the writing operation into the other memory, and changes over the working memory used for generation of the driving waveform by every interval. This arrangement enables the driving waveform to be quickly switched over by the unit of the interval. In the example of FIG. 15, the driving waveforms COM1 and COM2 are alternately generated. The sequence of generation of the driving waveforms COM1 and COM2 may be set arbitrarily. The appropriate driving waveform is selected according to the type of the dot to be created at each pixel. For example, in the case where any one of the multi-shot dots DSA, DMA, and DLA is to be created in a left most pixel and a second left pixel, the driving waveform COM1 is continuously output to these two pixels. In this case, while the driving waveform COM1 is generated with the data of the first memory 60A, the driving waveform data used for generating the driving waveform COM1 are written into the second memory 61A. A variety of other settings are applicable to the switchover timing of the working driving waveform.

The arrangement of the second embodiment is also applicable to the case of selectively using three or more driving waveforms.

The two memories are sufficient even in this case. This arrangement thus effectively saves the memory capacity required for generation of the driving waveform. One possible modification selectively uses three or more memories to generate the driving waveform.

In the second embodiment, data are written into the memory unconditionally. One preferable modification omits the writing operation in the case where a new set of driving waveform data to be written into the writing memory coincides with the existing set of driving waveform data already stored in the same writing memory.

C. Third Embodiment

Figure 16:
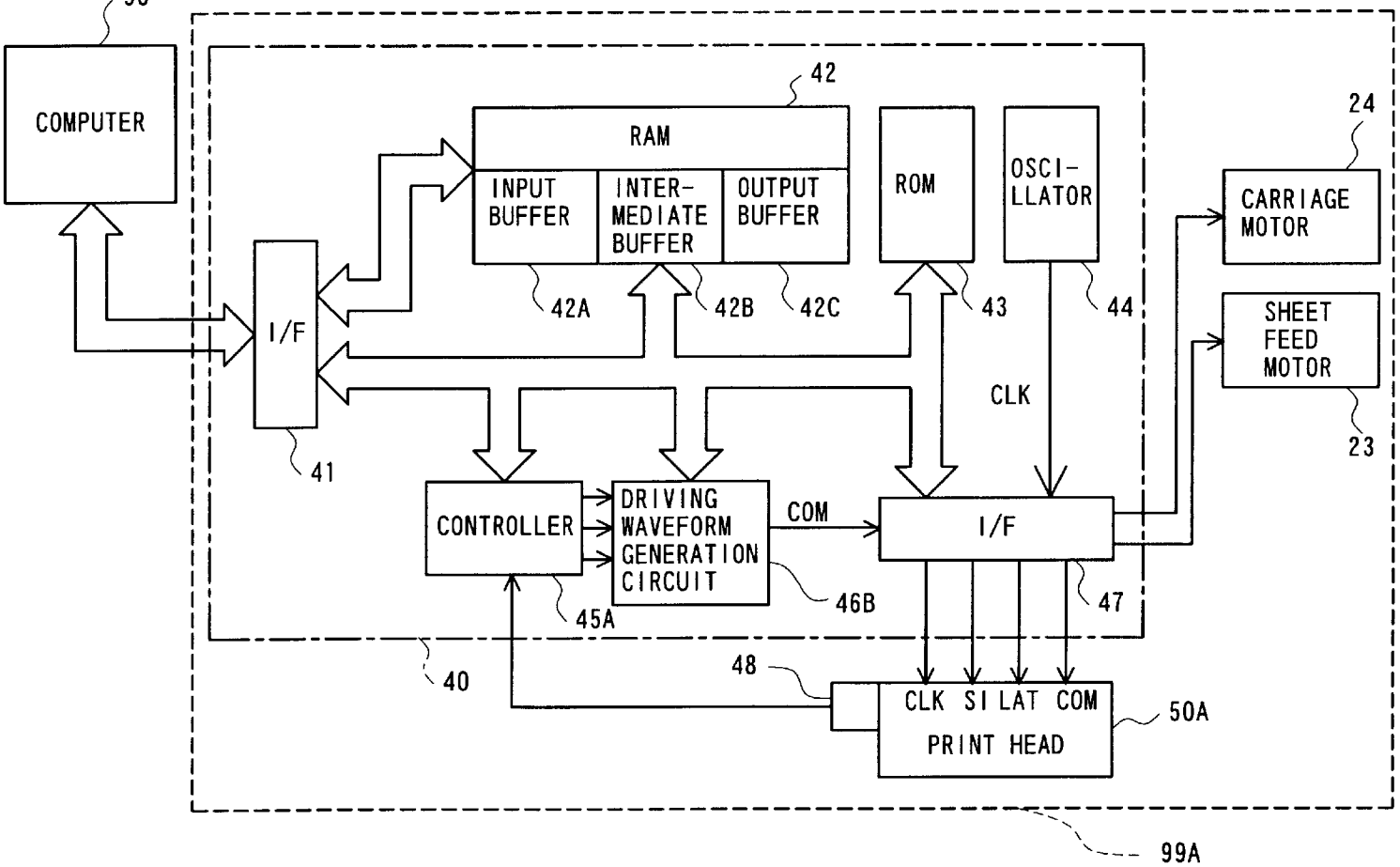
FIG. 16 is a block diagram illustrating the general structure of a printing apparatus in a third embodiment of the present invention.

FIG. 16 is a block diagram illustrating the general structure of a printing apparatus in a third embodiment of the present invention. The primary difference from the first and the second embodiments is that a print head 50A of a printer 99A is provided with a temperature sensor 48. The other constituents are identical with those of the printing apparatus of the first embodiment shown in FIG. 1. In the printing apparatus of the third embodiment, the combination of a driving waveform generation circuit 46B, a controller 45A, the RAM 42, the ROM 43, and the temperature sensor 48 functions as the driving waveform generating apparatus.

The temperature sensor 48 measures the temperature in the neighborhood of the print head 50A. The controller 45A carries out temperature correction based on the results of the measurement in the course of generating the driving waveforms. The viscosity of ink is generally affected by the temperature. The ink has the higher viscosity at the higher temperature and the lower viscosity at the lower temperature. In order to regulate the quantity of ink ejection accurately, it is accordingly effective to correct the driving waveform COM according to the temperature.

Figure 17A:
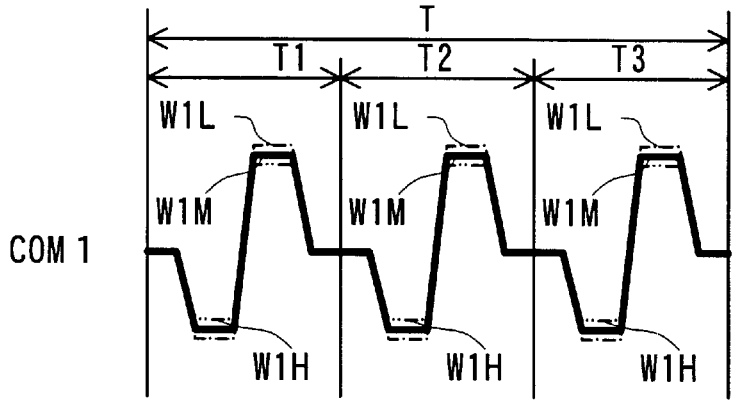
FIGS. 17A and 17B show a method of temperature correction with regard to the driving waveforms.
Figure 17B:
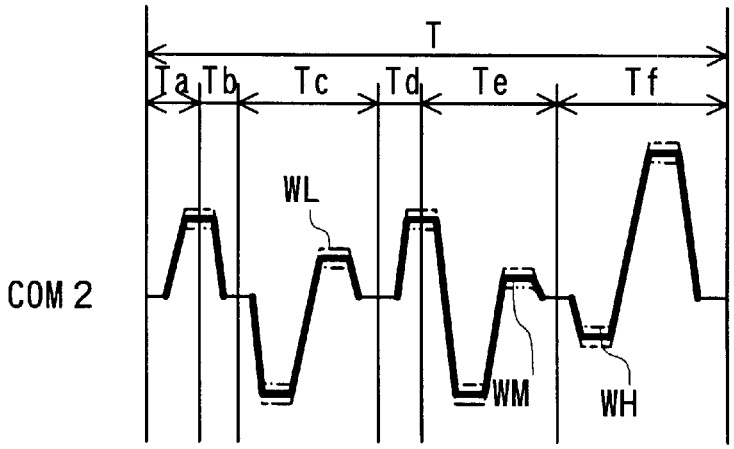
Figure 18:
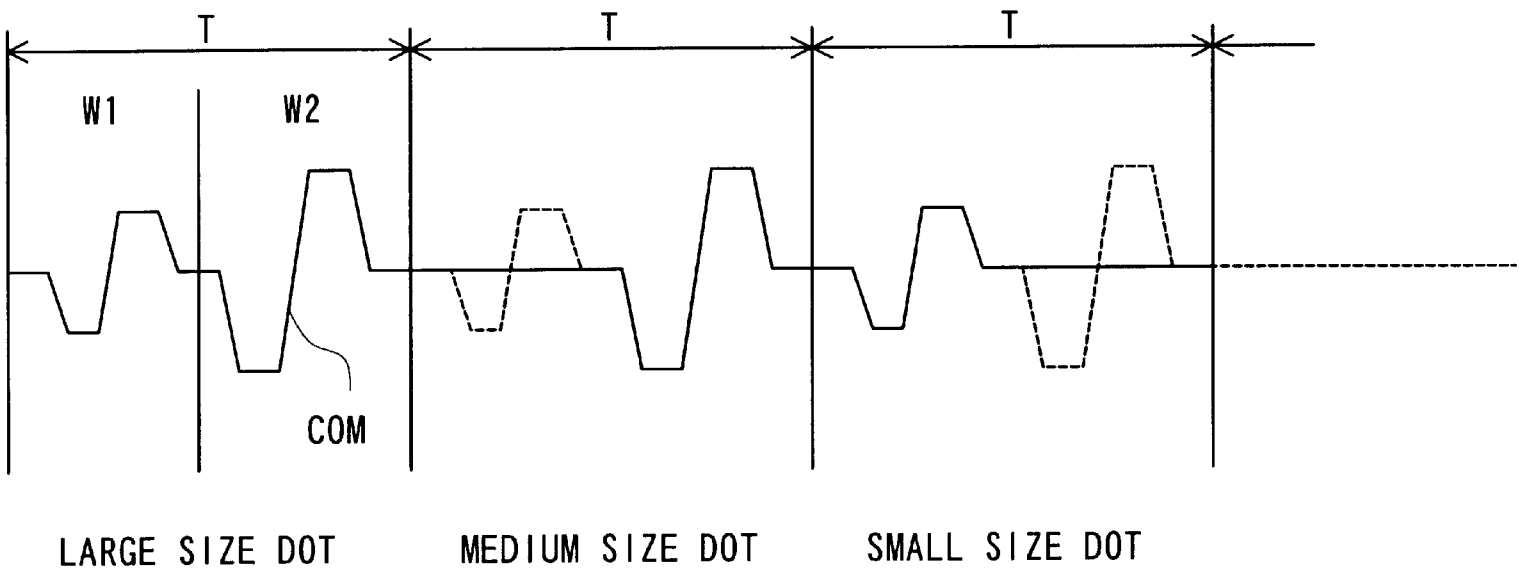
FIG. 18 illustrates a prior art driving waveform to create the variable size dots.
Figure 19:
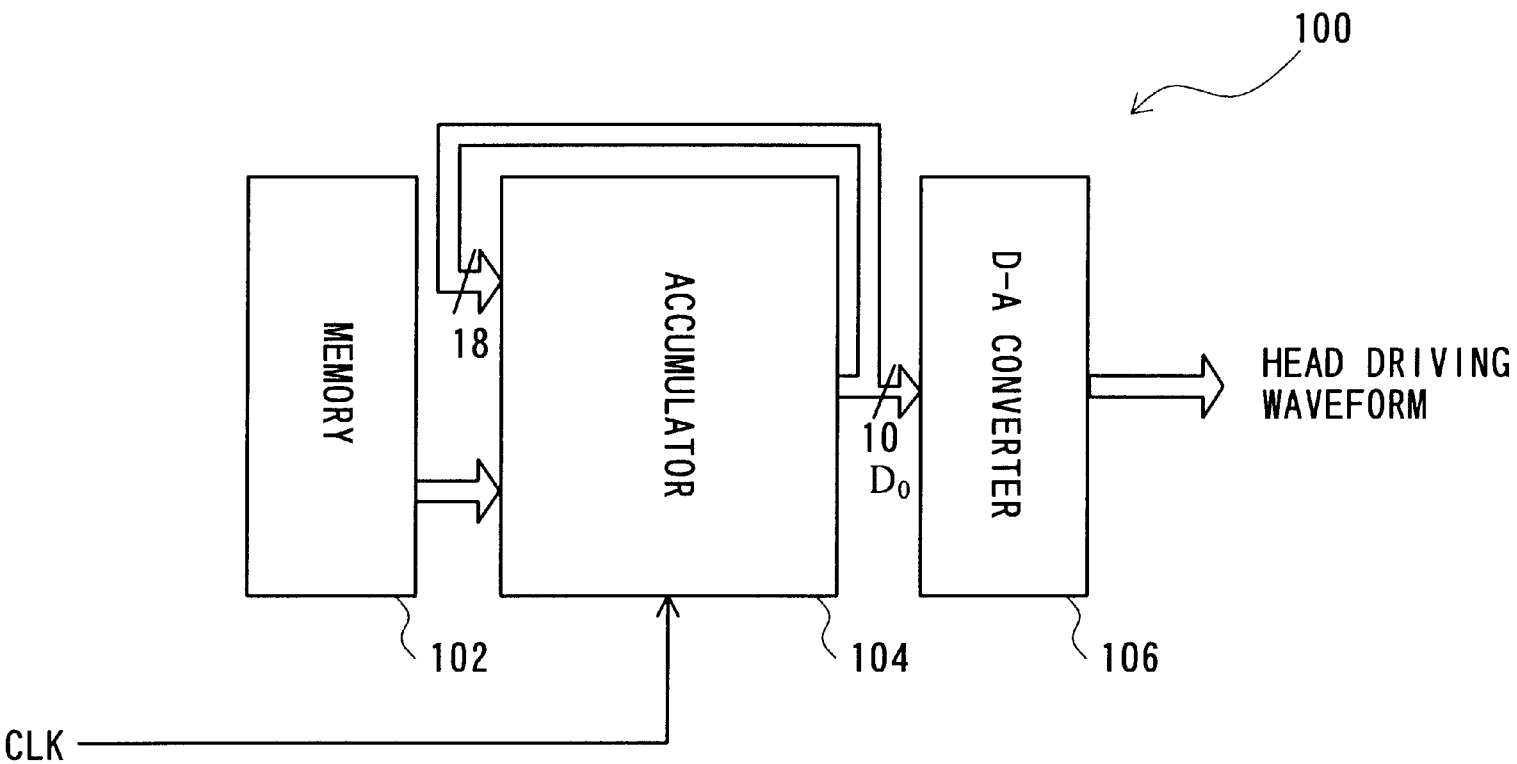
Fig. 19 PRIOR ART
FIG. 19 is block diagram illustrating the internal structure of a prior art driving waveform generation circuit.
Figure 20:
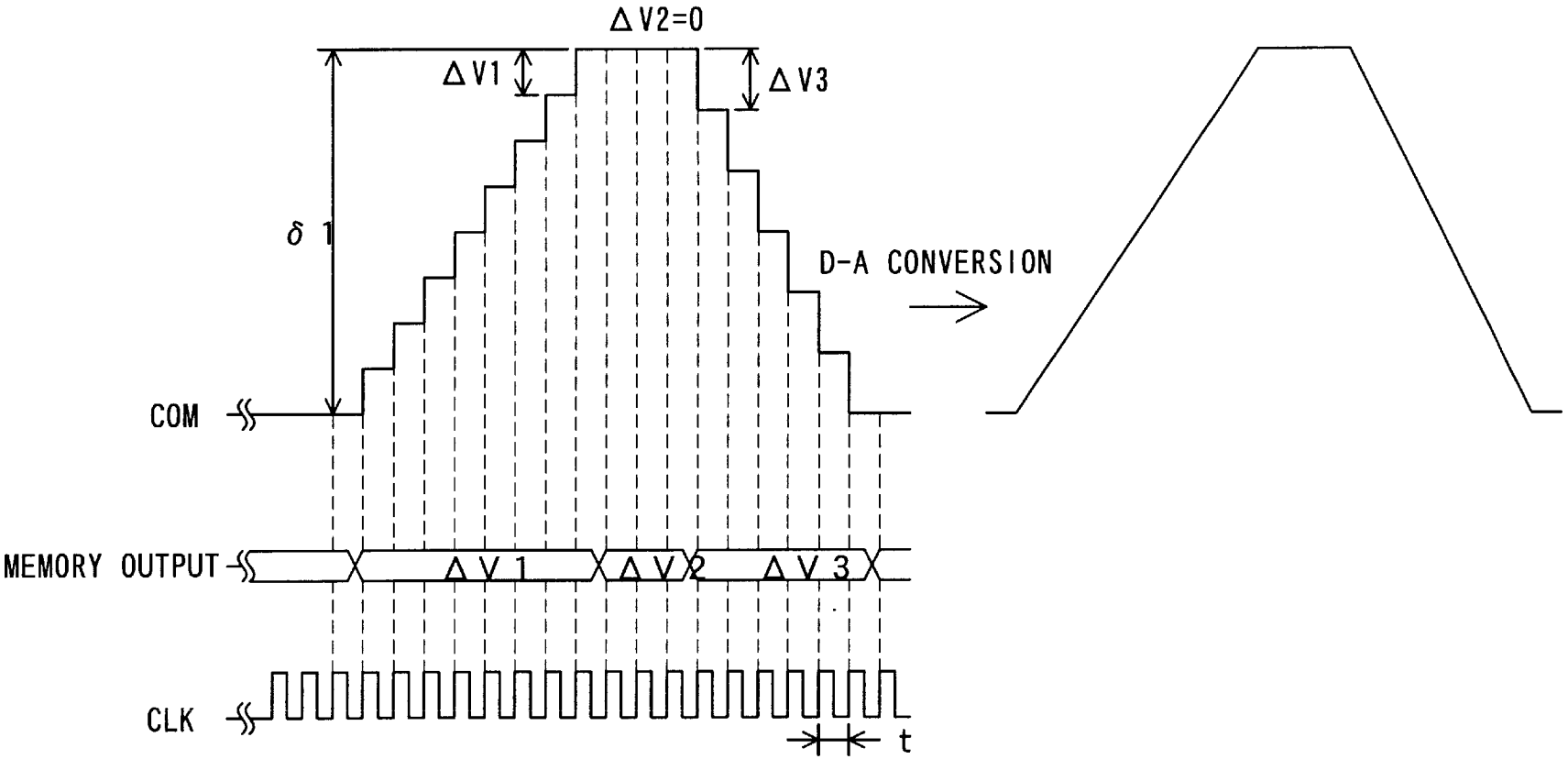
FIG. 20 shows a process of generating a driving waveform by the prior art programmable generation.

FIGS. 17A and 17B show a method of temperature correction with regard to the driving waveforms COM1 and COM2.

FIG. 17A shows the process of temperature correction with regard to the driving waveform COM1 for the multi-shot dots. An element waveform W1M in three sections T1 through T3 included in one pixel interval T is used when the print head 50A is at a predetermined reference temperature, for example, at 25° C. A corrected element waveform W1H is used at high temperatures, and another corrected element waveform W1L is used at low temperatures. Under the conditions of the high temperature of the print head 50A and thsu the high ink temperature, the ink has low viscosity. The driving waveform COM1 is accordingly corrected to reduce the amplitude. Under the conditions of the low temperature of the print head 50A, on the contrary, the ink has high viscosity. The driving waveform COM1 is accordingly corrected to enhance the amplitude.

As shown in FIG. 17B, the driving waveform COM2 for the variable size dots is corrected in the same manner as the driving waveform COM1 for the multi-shot dots. The procedure corrects a waveform WM, which is used at a predetermined reference temperature of the print head 50, to a waveform WH having the reduced amplitude at high temperatures and to a waveform WL having the enhanced amplitude at low temperatures.

A variety of methods are applicable for the temperature correction. One applicable method selectively uses the driving waveform data, which have been stored in advance in the ROM 43 and correspond to a plurality of temperature tanges. A modified procedure interpolates the stored data according to the observed temperature to calculate the driving waveform data. Another applicable method sets coefficients used for changing the amplitude according to the temperature and multiplies reference driving waveform data by a selected coefficient.

The execution or non-execution of the temperature correction may be determined according to the rate of temperature change or the quantity of temperature change. For example, the temperature correction may be carried out under the condition that there is a quantity of temperature change equal to or greater than a predetermined threshold value.

The driving waveform generation circuit 46B may have the structure of the first embodiment (see FIG. 4) or the structure of the second embodiment (see FIG. 11).

In the case where the driving waveform generation circuit 46B adopts the structure of the first embodiment using the single memory 60, the driving waveform is generated in the following manner. Plural sets of driving waveform data with required temperature correction including reference driving waveform data, driving waveform data for high temperatures, and driving waveform data for low temperatures are stored in the memory 60 together with the driving waveforms COM1 and COM2 used for printing. The controller 45A selectively uses the address signals, based on the driving waveform to be generated and the results of measurement with the temperature sensor 48. The switchover of the driving waveform is implemented at a variety of timings as discussed in the first embodiment.

In the case where the driving waveform generation circuit 46B adopts the structure of the second embodiment using the two memories 60A and 61A, on the other hand, the driving waveform is generated in the following manner. While a driving waveform is generated with a set of driving waveform data read from one memory, another set of driving waveform data used for generation of a subsequent driving waveform are written into the other memory. The set of driving waveform data written into the memory are specified by taking into account the type of the resulting driving waveform and the effects of the temperature correction. The alternate use of the two memories enables the driving waveform with the reflection of the temperature correction to be effectively switched over.

An extremely large memory capacity would be required to store all the pieces of driving waveform data including those with temperature correction. Application of the structure of the second embodiment for the driving waveform generation circuit 46B advantageously prevents an extreme increase in memory capacity. This arrangement enables a diversity of driving waveforms to be utilized without undue restriction due to the memory capacity, thus ensuring the precise temperature correction.

In the arrangement of the third embodiment, the timing of the temperature correction may be set arbitrarily. It is not necessary to make the timing of the temperature correction coincident with the switchover interval of the driving waveform. One applicable procedure carries out the temperature correction of the driving waveform COM at every one pixel interval of the driving waveform COM corresponding to one pixel division. Another applicable procedure sets a time interval corresponding to two passes of the main scan to the interval of the temperature correction, while setting a time interval corresponding to one pass of the main scan to the switchover interval of the driving waveform.

Althoug the waveforms are corrected as a function of the temperature in the third embodiment, a variety of physical quantities affecting the ink ejection properties may be used as the correction parameter. For example, a humidity sensor may be attached to the print head 50A, and the driving waveform COM is corrected according to the observed humidity. These sensors may not be mounted directly on the print head 50A, but may be set at any suitable positions to detect the effects on the ink ejection properties.

The present invention is not restricted to the above embodiments or their modifications, but there may be many other modifications, changes, and alterations without departing from the scope or spirit of the main characteristics of the present invention. For example, the driving elements are not restricted to the piezoelectric elements, but may be any of various actuators selected according to the requirements.

The scope and spirit of the present invention are limited only by the terms of the appended claims.

What is claimed is:

1. A method of generating driving waveforms to actuate driving elements of a print head, said method comprising the step of:

selectively generating one of a plurality of different driving waveforms having different shapes and polarities at predetermined intervals of selection, said step of selectively generating comprising the steps of:

(a) providing a plurality of memory areas that do not overlap one another in the entirety;

(b) storing at least two sets of driving waveform data for generating the different driving waveforms into at least two of the memory areas;

(c) selecting one of the memory areas at the predetermined intervals of selection;

(d) reading out the driving waveform data from the selected memory area, thereby changing over a resulting driving waveform; and (e) successively accumulating the read-out driving waveform data at a preset accumulation timing.

2. A method in accordance with claim 1, wherein the predetermined intervals of selection correspond to one pixel division.

3. A method in accordance with claim 1, wherein the plurality of different driving waveforms having different shapes include a reference driving waveform and a corrected driving waveform, which is obtained by correcting the reference driving waveform with a predetermined parameter that affects printing properties of said print head.

4. A method in accordance with claim 3, wherein the predetermined parameter includes at least one of an environmental temperature and an environmental humidity.

5. A method of generating driving waveforms to actuate driving elements of a print head, said method comprising the step of:

selectively generating one of a plurality of different driving waveforms having different shapes at predetermined intervals of selection;

said step of selectively generating comprising the steps of:

(a) providing a plurality of memory areas which do not overlap one another in the entirety;

(b) storing at least two sets of driving waveform data for generating the different driving waveforms into at least two of the memory areas; and (c) selecting one of the memory areas at the predetermined intervals of selection, and reading out the driving waveform data from the selected memory area, thereby changing over a resulting driving waveform, wherein the specific number of memory areas is identical with the number of the different driving waveforms, and said step (c) comprises the steps of:

selecting a driving waveform to be generated at the predetermined interval of selection;

sequentially reading a set of driving waveform data, corresponding to the selected driving waveform, out of the corresponding memory area at a preset timing;

successively accumulating the read-out driving waveform data at a preset accumulation timing; and carrying out digital-to-analog conversion of the accumulated result to generate a driving waveform signal.

6. A method of generating driving waveforms to actuate driving elements of a print head, said method comprising the step of:

selectively generating one of a plurality of different driving waveforms having different shapes at predetermined intervals of selection, said step of selectively generating comprising the steps of:

(a) providing a plurality of memory areas which do not overlap one another in the entirety;

(b) storing at least two sets of driving waveform data for generating the different driving waveforms into at least two of the memory areas; and (c) selecting one of the memory areas at the predetermined intervals of selection and reading out the driving waveform data from the selected memory area, thereby changing over a resulting driving waveform, wherein a reading/writing operation of each memory area may be done independently of operations of the other memory areas, wherein said step (b) carrying out the writing operation of a set of driving waveform data into one memory area in parallel with the reading operation of another set of driving waveform data from another memory area in said step (c), and wherein said step (c) includes the steps of:

successively selecting one memory area for the reading operation in a preset sequence at the predetermined intervals of selection;

sequentially reading the driving waveform data out of the selected memory area at a preset timing;

successively accumulating the read-out driving waveform data at a preset accumulation timing; and carrying out digital-to-analog conversion of the accumulated result to generate a driving waveform signal.

7. A driving waveform generating apparatus that generates driving waveforms to actuate driving elements of a print head, said driving waveform generating apparatus comprising:

a memory unit in which driving waveform data used to generate a plurality of driving waveforms having different shapes are stored, said memory unit having a plurality of memory areas that do not overlap one another in the entirety;

a controller configured to respectively store at least two sets of driving waveform data representing the different driving waveforms into at least two of the memory areas, and select one of the memory area used for generation of a driving waveform at a predetermined interval of selection;

an accumulator configured to successively accumulate a set of driving waveform data at a preset accumulation timing, which is read out of the memory area selected by said controller at a preset read-out timing; and a digital-to-analog converter configured to carry out digital-to-analog conversion of an accumulation result obtained by said accumulator, so as to generate a driving waveform signal.

8. A driving waveform generating apparatus in accordance with claim 7, wherein the predetermined interval of selection corresponds to one pixel division.

9. A driving waveform generating apparatus in accordance with claim 7, wherein said memory unit comprises at least two memories respectively corresponding to the plurality of memory areas, and said controller carries out a writing operation into one memory included in said memory unit in parallel with a reading operation from another memory.

10. A driving waveform generating apparatus in accordance with claim 9, wherein said controller omits the writing operation in the case where a new set of driving waveform data to be written into a writing memory is coincident with an existing set of driving waveform data already stored in the same writing memory.

11. A driving waveform generating apparatus in accordance with claim 7, wherein the predetermined interval of selection corresponds to one pass of main scan of said print head.

12. A driving waveform generating apparatus in accordance with claim 7, said driving waveform generating apparatus further comprising:

at least either one of a temperature sensor that measures an environmental temperature and a humidity sensor that measures an environmental humidity, wherein said controller supplies driving waveform data, which are corrected based on at least one of the observed environmental temperature and the observed environmental humidity, to said memory unit.

13. A printing apparatus that records an image on a printing medium, based on print data of an image to be printed, said printing apparatus comprising:

a print head having a plurality of nozzles and a plurality of driving elements that drive said plurality of nozzles to eject ink droplets; and a driving waveform generating apparatus including;

a memory unit in which driving waveform data used to generate a plurality of driving waveforms having different shapes are stored, said memory unit having a plurality of memory areas that do not overlap one another in the entirety;

a controller configured to respectively store at least two sets of driving waveform data representing the different driving waveforms into at least two of the memory areas, and select one of the memory area used for generation of a driving waveform at a predetermined interval of selection;

an accumulator configured to successively accumulate a set of driving waveform data at a preset accumulation timing, which is read out of the memory area selected by said controller at a preset read-out timing; and a digital-to-analog converter configured to carry out digital-to-analog conversion of an accumulation result obtained by said accumulator, so as to generate a driving waveform signal.

14. A driving waveform generating apparatus that generates driving waveforms to actuate driving elements of a means for printing, said driving waveform generating apparatus comprising:

means for storing driving waveform data used to generate a plurality of driving waveforms having different shapes and polarities, said means for storing having a plurality of memory areas that do not overlap one another in the entirety;

means for controlling configured to store at least two sets of driving waveform data representing different driving waveforms into at least two of the memory areas and for selecting one of the memory areas used for generation of a driving waveform at a predetermined interval of selection; and means for accumulating configured to successively accumulate a set of driving waveform data at a preset accumulation timing that is read out of the memory area selected by said means for controlling at a preset read-out timing.

15. The driving waveform generating apparatus in accordance with claim 14, wherein the predetermined interval of selection corresponds to one pixel division.

16. The driving waveform generating apparatus in accordance with claim 14, wherein said means for storing comprises at least two memories corresponding to the plurality of memory areas, and said means for controlling carries out a writing operation into one memory included in said means for storing in parallel with a reading operation from another memory.

17. The driving waveform generating apparatus in accordance with claim 14, wherein the predetermined interval of selection corresponds to one pass of a main scan of said means for printing.

18. The driving waveform generating apparatus in accordance with claim 16, wherein said means for controlling omits the writing operation in a case where a new set of driving waveform data to be written into a written memory is coincident with an existing set of driving waveform data already stored in the writing memory.

19. The driving waveform generating apparatus in accordance with claim 14, further comprising:

at least either one of a first means for sensing that measures an environmental temperature and a second means for sensing that measures an environmental humidity, wherein said means for controlling supplies driving waveform data to said means for storing that are corrected based on at least one of the observed environmental temperature and the observed environmental humidity.

20. A printing apparatus that records an image on a printing medium, based on print data of an image to be printed, comprising:

means for printing having a plurality of nozzles and a plurality of driving elements that drives said plurality of nozzles to eject ink droplets; and means for generating a driving waveform further comprising:

means for storing waveform data used to generate a plurality of driving waveforms having different shapes and polarities, said means for storing having a plurality of memory areas that do not overlap one another in the entirety;

means for controlling configured to store at least two sets of driving waveform data representing the different driving waveforms into at least two of the memory areas and for selecting one of the memory areas used for generation of a driving waveform at a predetermined interval of selection;

means for accumulating configured to successively accumulate a set of driving waveform data at a preset accumulation timing that is read out of the memory area selected by said means for controlling at a preset read-out timing.

* * * * *